US006887046B2

(12) United States Patent
Repple et al.

(10) Patent No.: US 6,887,046 B2
(45) Date of Patent: May 3, 2005

(54) COOLANT PUMP, MAINLY FOR AUTOMOTIVE USE

(75) Inventors: Walter Otto Repple, London (CA); John Robert Lewis Fulton, Royal Oak, MI (US)

(73) Assignee: Flowork Systems II LLC, Royal Oak, MI (US)

( * ) Notice: Subject to any disclaimer, the term of this patent is extended or adjusted under 35 U.S.C. 154(b) by 103 days.

(21) Appl. No.: 10/330,108

(22) Filed: Dec. 30, 2002

(65) Prior Publication Data

US 2003/0143084 A1 Jul. 31, 2003

Related U.S. Application Data

(63) Continuation-in-part of application No. 09/848,224, filed on May 4, 2001, now Pat. No. 6,499,963, and a continuation-in-part of application No. 09/125,861, filed on Aug. 23, 1998, now Pat. No. 6,309,193.

(30) Foreign Application Priority Data

Feb. 26, 1996 (GB) ..... 9604042
Feb. 25, 1997 (CA) ..... PCT/CA97/00123

(51) Int. Cl.[7] ..... F04B 53/00

(52) U.S. Cl. ..... 417/313; 417/292; 417/295; 417/298; 62/277; 416/175; 416/203; 416/223 B; 416/185

(58) Field of Search ..... 417/313, 292, 417/295, 298; 416/175, 203, 223 B, 185; 62/277

(56) References Cited

U.S. PATENT DOCUMENTS

| | | | | | |
|---|---|---|---|---|---|
| 5,029,449 | A | * | 7/1991 | Wilkinson | 62/175 |
| 5,056,601 | A | * | 10/1991 | Grimmer | 165/47 |
| 5,226,787 | A | * | 7/1993 | Freeman | 415/168.2 |
| 5,248,244 | A | * | 9/1993 | Ho et al. | 417/292 |
| 5,454,695 | A | * | 10/1995 | Shah et al. | 416/203 |
| 5,570,998 | A | * | 11/1996 | Nomoto | 416/186 R |
| 5,738,658 | A | * | 4/1998 | Maus et al. | 604/151 |
| 5,755,557 | A | * | 5/1998 | Alizadeh | 416/193 R |
| 5,894,735 | A | * | 4/1999 | Misawa et al. | 62/177 |
| 6,309,193 | B1 | * | 10/2001 | Repple et al. | 417/423.8 |
| 6,499,963 | B2 | * | 12/2002 | Repple et al. | 417/292 |

FOREIGN PATENT DOCUMENTS

| | | | |
|---|---|---|---|
| JP | 06330897 | A | * 11/1994 |
| JP | 08219565 | A | * 2/1995 |
| JP | 08233416 | A | * 2/1995 |
| JP | 08093691 | A | * 4/1996 |
| JP | 2003307197 | A | * 10/2003 |

* cited by examiner

*Primary Examiner*—Cheryl J. Tyler
*Assistant Examiner*—Emmanuel Sayoc
(74) *Attorney, Agent, or Firm*—Anthony Asquith Co.

(57) ABSTRACT

An impeller pump with thermostatically adjustable guide vanes is suitable for use as an automotive coolant pump. The pump is driven by a constant speed electric motor, and flow variation is controlled by varying the orientation of the vanes. Orientation of the vanes is effected by a wax-type thermostat, which senses coolant temperature: flow is increased when the coolant is hot, and decreased as the coolant cools. The variable guide vanes are mounted for pivoting about radial axes, and are located just upstream from the pump impeller.

19 Claims, 25 Drawing Sheets

FIG. 24

| 1 | Targeted System Operational Modes/Flow & Pressure Map | | | | | | | | | |
|---|---|---|---|---|---|---|---|---|---|---|
| | Average Ambient Temp C | Vehicle Mode | Approx. Load % | Engine RPM | HiPres Impelr | Rad Valve & Vane Temp Controlled Points | | Valve Functional Position | Relative Flow Amount | Primary Mode Description |
| | | | | | | Valve Pos'n | Vanes Pos'n | | | |
| Primary Cold Ambient Operational Modes | | | | | | | | | | |
| | (coolant temp below 90 C) | | | | | | | | | |
| 1 | -7 | Warm-up | 0 to 25 | 700 | On | Closed | n/a | Htr/EOC | HtrOnly | Below 90C (194F) the vanes are in full positive spin position and flow to |
| | | (1st 500 s.) | | | | | | | | the radiator is blocked. The Dual Impeller develops relatively higher |
| 2 | -7 | Idle stop | 0 to 25 | 550 | On | Closed | n/a | Htr/EOC | HtrOnly | pressure at low speed to push coolant through the heater circuit. |
| | (coolant between 90 and 100 C) | | | | | | | | | |
| 3 | -7 | Road Load | 25-100 | 2200 | Off | Open | positive | Htr/EOC&Rad | minRad | At 90C flow to the radiator begins and between 90-100C (to 212F) the |
| | | | | | | | | | | vanes modulate from positive to near neutral position. At low ambient |
| 4 | -7 | Headwind | 75-100 | 3500 | Off | Open | positive | Htr/EOC&Rad | minRad | conditions this operating range significantly modulates flow to augment |
| | | | | | | | | | | radiator flow reduction thus reducing thermal shock associated with |
| Primary Warm Ambient Operational Modes | | | | | | | | | | conventional "open-closed" thermostat operation. |
| | (coolant between 100 and 115 C) | | | | | | | | | |
| 6 | 37 | Part Load | 25-50 | 1800 | On | Open | neutral | Htr/EOC&Rad | neutral | The actuator (power pill) gain is designed to remain relatively flat in this |
| | (coolant above 115 C) | | | | | | | | | nominal "part-load" operating range to 115C (239F). |
| 5 | 43 | Thermal Idle | 0-25 | 700 | On | Open | n/a | Htr/EOC&Rad | maxidle | Due to low speed, flow augmentation is provided by the Dual Impeller. |
| | | | | | | | | | | Above 115C (239F) the vanes move towards maximum negative spin. |
| | | | | | | | | | | At high ambient and load conditions which drive coolant above 115C |
| 7 | 43 | Trailer Grade | 75-100 | 3500 | Off | Open | negative | Htr/EOC&Rad | maxRad | (239F) the negative spin boosts flow for increased cooling capacity. |
| | (coolant between 100 and 115 C) | | | | | | | | | |
| 8 | 37 | Pump Layout | | 5500 | Off | Open | neutral | Htr/EOC&Rad | mid | This is a maximum pump layout point as for high load and ambient. |
| 9 | 43 | Main Impeller | | 2500 | Off | Open | negative | Htr/EOC&Rad | max | This is the nominal pump layout point as for part-load operation. |
| General Assumptions | | | | | | | | | | |
| It may be possible to use a single motion proportional to temperature that motivates both valve and vanes as shown. | | | | | | | | | | |
| Both warm-up and hot idle modes typically have engine speed "bump-up" algorithms as shown. | | | | | | | | | | |

COOLANT PUMP, MAINLY FOR AUTOMOTIVE USE

This is a Continuation-in-Part of patent application Ser. No. 09/848,224, filed 4 May 2001, now granted and issued as U.S. Pat. No. 6,499,963, derived from patent application Ser. No. 09/125,861, filed 23 Aug. 1998, now granted as U.S. Pat. No. 6,309,193, issued 30 Oct. 2001, derived from PCT/CA-97/00123, filed 25 Feb. 1997, claiming priority date of 26 Feb. 1996 from GB-96/4042.3.

This invention relates to coolant pumps for automotive internal-combustion engines. The invention is aimed at providing a coolant pump which delivers flow characteristics in accordance with engine demand.

BACKGROUND TO THE INVENTION

Pumps for internal-combustion engine cooling systems have traditionally been belt-driven, at a fixed ratio, directly from the engine.

The coolant flow rate and pressure head required to effectively control the engine temperature are not, however, optimal when driven proportionally to the engine's rotational speed. The coolant system has to cope with the fully-laden vehicle struggling up-hill on a hot day, and the same system has to make sure the heater warms up rapidly in very cold conditions. Also, for efficiency, the energy consumed by the coolant pump ideally should at all times be only the minimum needed to just achieve the optimum temperature in the coolant. Whatever coolant circulation system is used, it must of course cater for the extremes; in the case of the traditional belt-driven coolant pumps, the need to cater for the extremes so compromises the efficiency of normal running that traditional coolant pumps are inherently non-optimal for most of their operating conditions.

The optimum coolant temperature is dictated by considerations of engine performance, fuel efficiency, exhaust emissions, etc. The coolant circulation system must provide a volumetric flow rate, and a pressure head, such that the coolant is cooled down (or warmed up) to the correct temperature under the extreme conditions. The invention is aimed at making it possible still to accommodate the extremes, and yet to improve the efficiency of the coolant circulation system during normal running, so that the system consumes only a minimum of energy during normal running.

When the coolant pump provides excessive flow and head, the engine wastes power and the overall engine efficiency is reduced.

When the coolant pump provides insufficient coolant flow and head, the engine runs too hot, thereby reducing engine performance, and perhaps damaging the engine.

Engine designers have not, in general, switched to driving coolant pumps by means of electric motors. This fact should be viewed in light of the fact that it is very common for a designer to specify that the engine's cooling fan to be driven by an electric motor. There, the motor runs at constant speed, and is controlled simply by being switched on/off: the need for switching is signalled by a simple electrical thermostat. That is a simple enough duty requirement for an electric motor to be subjected to.

It is recognized, however, that a simple on/off control would be far too crude for controlling the flow of coolant. Even under the minimum coolant flow conditions, the coolant must still be pumped and circulated quite vigorously.

It might be considered that, if an electrically-driven coolant pump were to be provided, it would be possible to control the coolant flow by controlling the rotational speed of the electric motor. Theoretically, this could be done by varying the electric current supplied to the motor that drives the coolant pump. However, such control of the motor speed by control of the motor current has not found favour with engine designers.

Thus, in considering the use of an electric motor to drive the coolant pump, it is apparent, first, that simple thermostatic on/off switching of a pump motor is out of the question, and second, trying to control motor-speed by controlling the current supplied to the electric motor has not found favour. And, even as a last resort, the notion of controlling coolant-flow by means of coupling the pump to a fixed speed motor by means of a mechanical variable speed drive, must be contra-indicated out as being far too elaborate; also, as mentioned, it is important that the pump, as well as the motor, should run at constant speed.

The invention is aimed at making it possible to vary the coolant flow to suit many different conditions, in a way which allows the pump (and hence the motor) to run at constant speed.

GENERAL PRINCIPLES OF THE INVENTION

The design configurations as will be described herein employ variable pitch guide vanes to affect the velocity, flow rate, pressure head, etc. of the coolant. The guide vanes are located adjacent to the impeller of the coolant pump, in the flow of coolant as it passes through the pump. The vanes are operated in response to a temperature signal corresponding to the actual cooling demand of the engine. The guide vanes serve to boost or to reduce the flow of coolant through the impeller, the change between boost and reduce being effected as a consequence of a change in the positional orientation of the vane in relation to the impeller of the pump.

The heat rejection demand is made dependent upon the temperature of the system, not engine speed. The system temperature might, for example, be taken as the temperature of the cooling fluid, or the temperature of a particular location on a machine, such as near the exhaust valves on the cylinder heads of an internal combustion engine. The system temperature may be transduced into a mechanical displacement which adjusts the pitch of a set of the guide vanes, which are preferably located just upstream of the impeller. When the system temperature is high, the thermostatic transducer adjusts the vanes such that the impeller pump provides a high coolant flow rate; when the system temperature is low the vanes are adjusted to provide a lower coolant flow rate.

It should be noted that, in an internal combustion engine, it is required that the coolant flow be maintained at all times during operation of the engine. The minimum flow demand is still a substantial flow. The engine would overheat in a few seconds if flow were actually to stop. Thus, it will be understood that the flow rate being controlled is just the upper fraction of the maximum flow rate—an area of flow in which it is notoriously difficult for a designer to achieve a desired degree of linearity of control. It is recognized that controlling just the upper fraction of the flow rate is not only easy with the variable pitch vanes, but, when the vanes are moved, the change in flow rate is not too far from being more or less linearly proportional to the movement of the vane. This means that simple automotive wax-type thermostats can be used directly, since they too have a more or less linear temperature/movement characteristic.

The use of variable pitch guide vanes combined with a modern high-speed impeller produces increased hydrodynamic flow efficiency over a wide range of flow rates, and provides capability to reduce the flow rate when the demand decreases. In contrast to a conventional direct drive impeller pump which frequently provides excessive coolant flow and uses excessive power, the temperature-responsive variable vane system as described herein, can provide precisely the correct amount of coolant flow to maintain optimum system operating temperatures, while consuming less power.

This pump's variable hydrodynamic flow/pressure capability, even though driven at a reasonably constant speed, provides thermal controllability while eliminating the need for a variable or multiple speed electrical motor. Increased hydrodynamic flow efficiency combined with the use of small high-speed motors can result in the overall pump package being small, lightweight, efficient, and easy to integrate within a given cooling system's special constraints.

The thermostatic signal can be transduced directly into a mechanical displacement of the guide vanes, for simple systems. For more sophisticated systems, a thermal signal can be processed by the engine management system which then controls an electrically-activated displacement mechanism to adjust the guide vanes.

DETAILED DESCRIPTION OF PREFERRED EMBODIMENTS

By way of further explanation of the invention, exemplary embodiments of the invention will now be described with reference to the accompanying drawings. In which.

Figures 2, 2A:
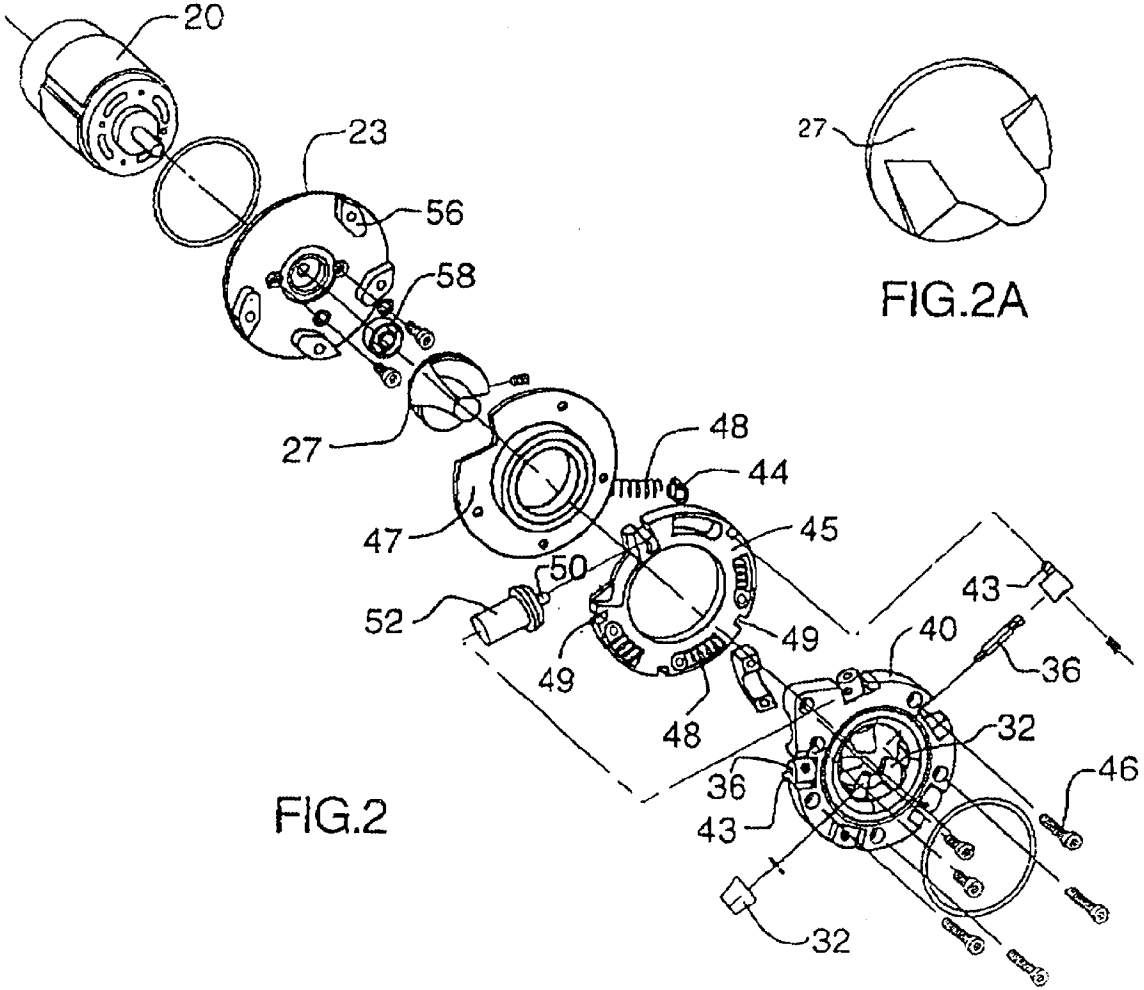
FIG. 2 is a pictorial exploded view of the components of a water pump for an automotive engine, which embodies the invention.
Figure 3:
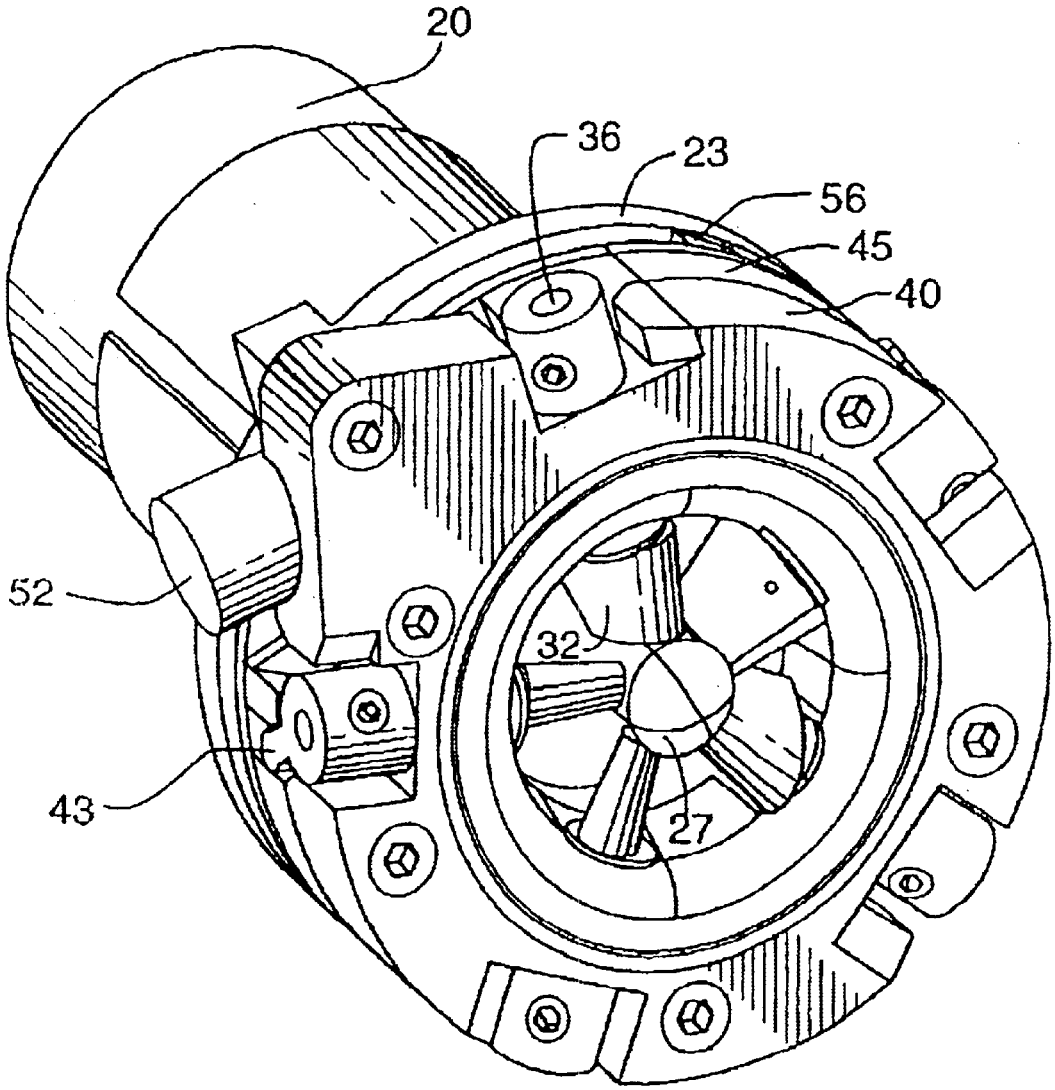
Figure 4:
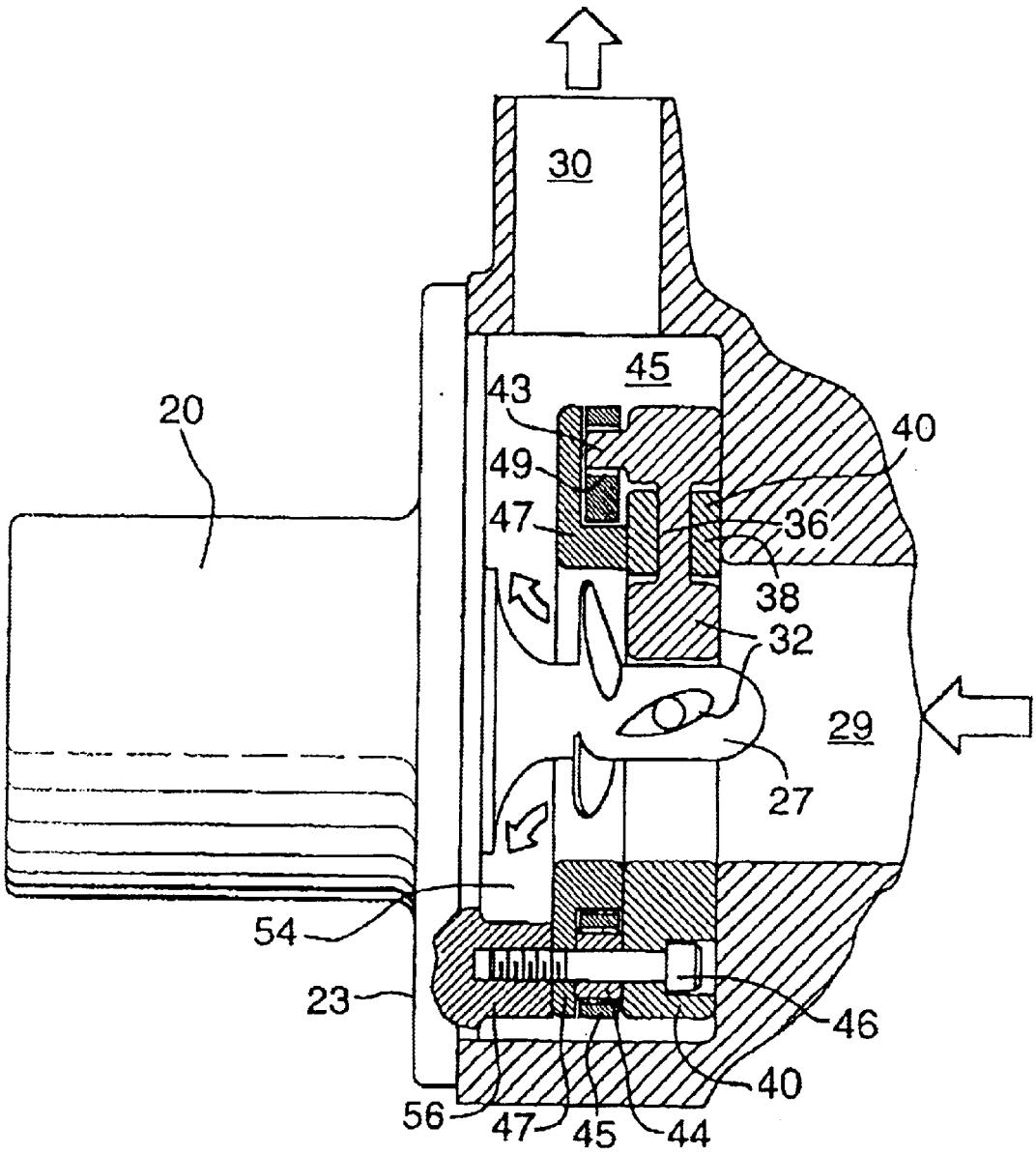
Figure 5:
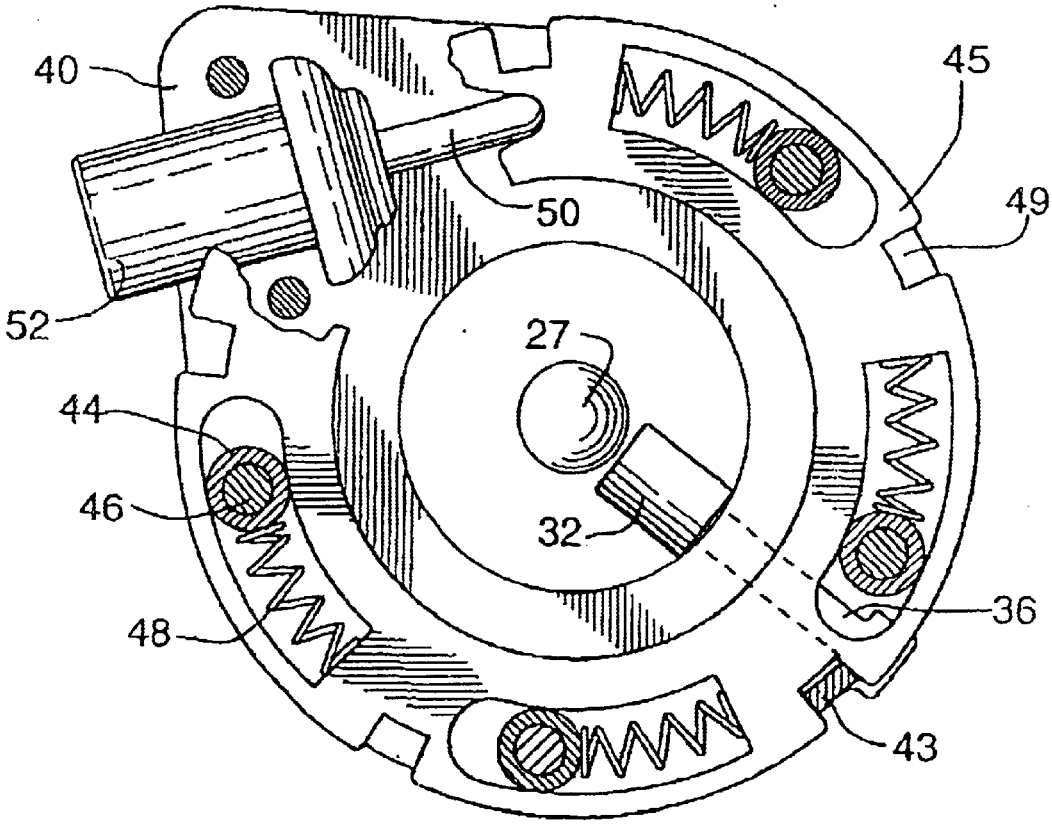
Figure 6:
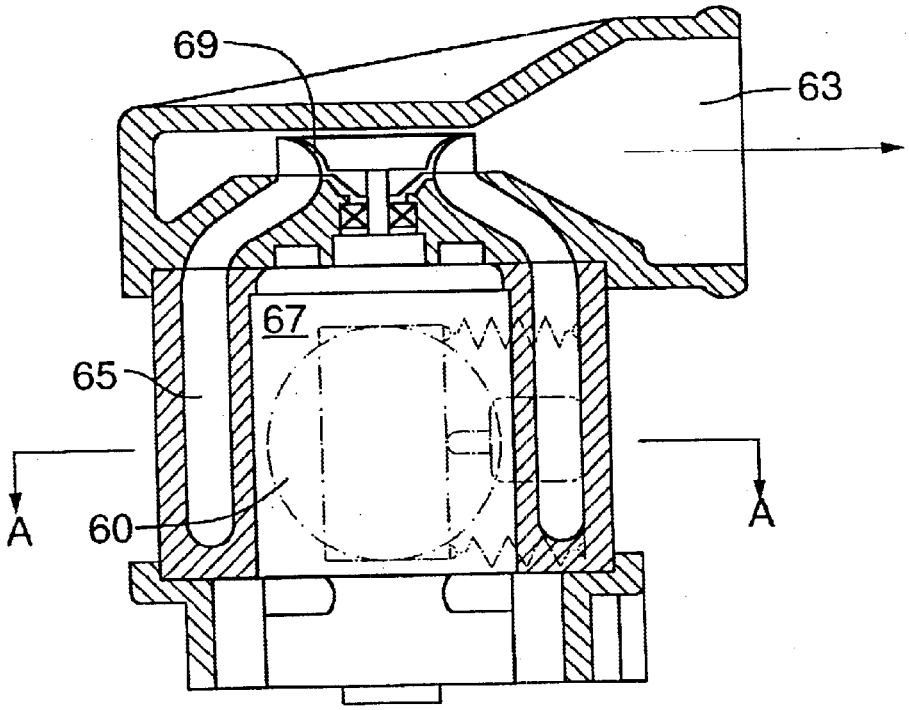
Figure 7:
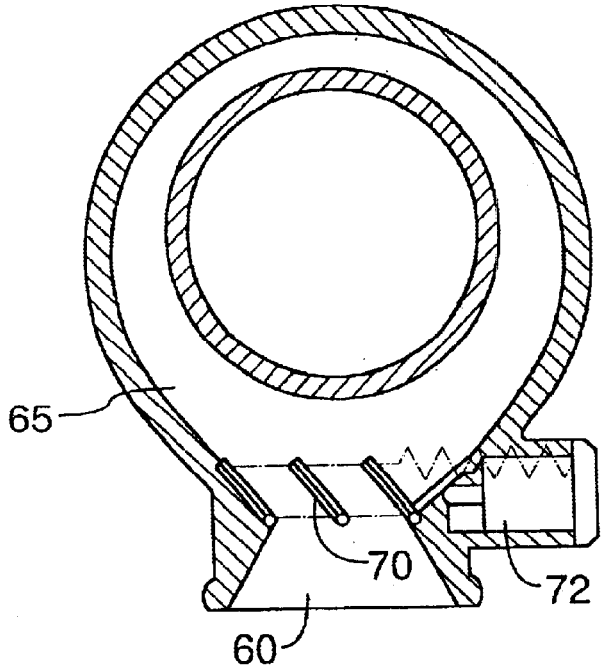
Figure 9:
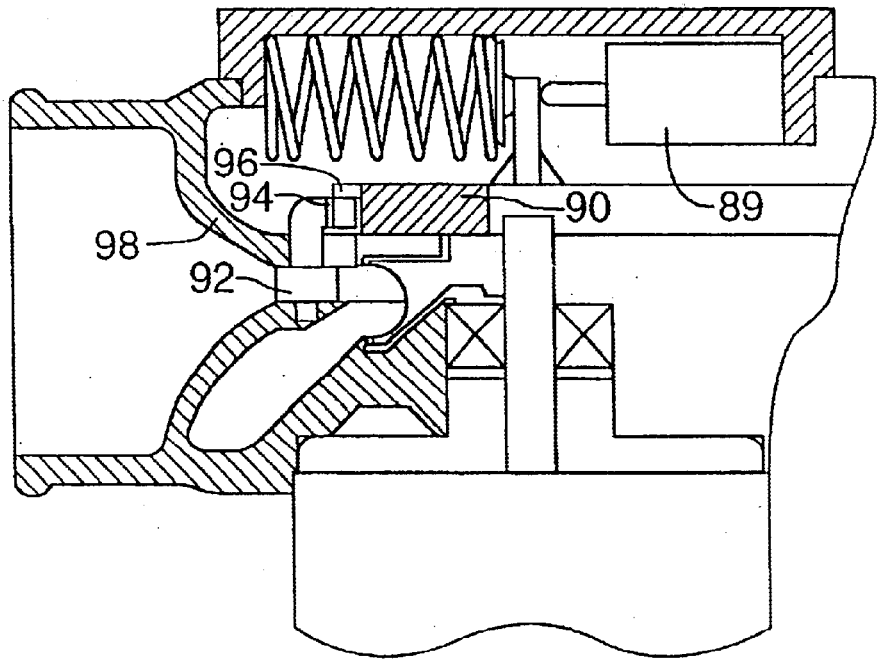
Figure 10:
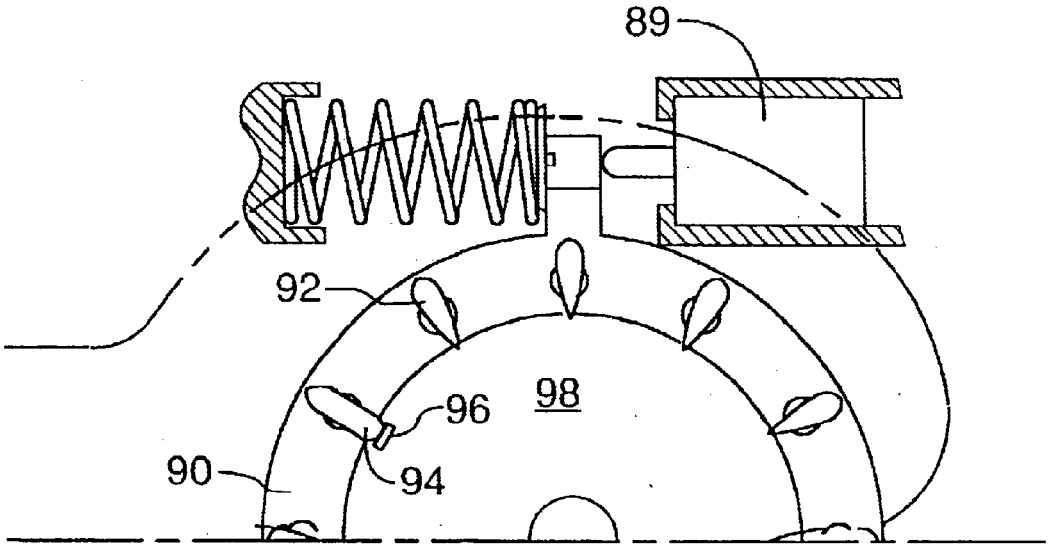
Figure 8:
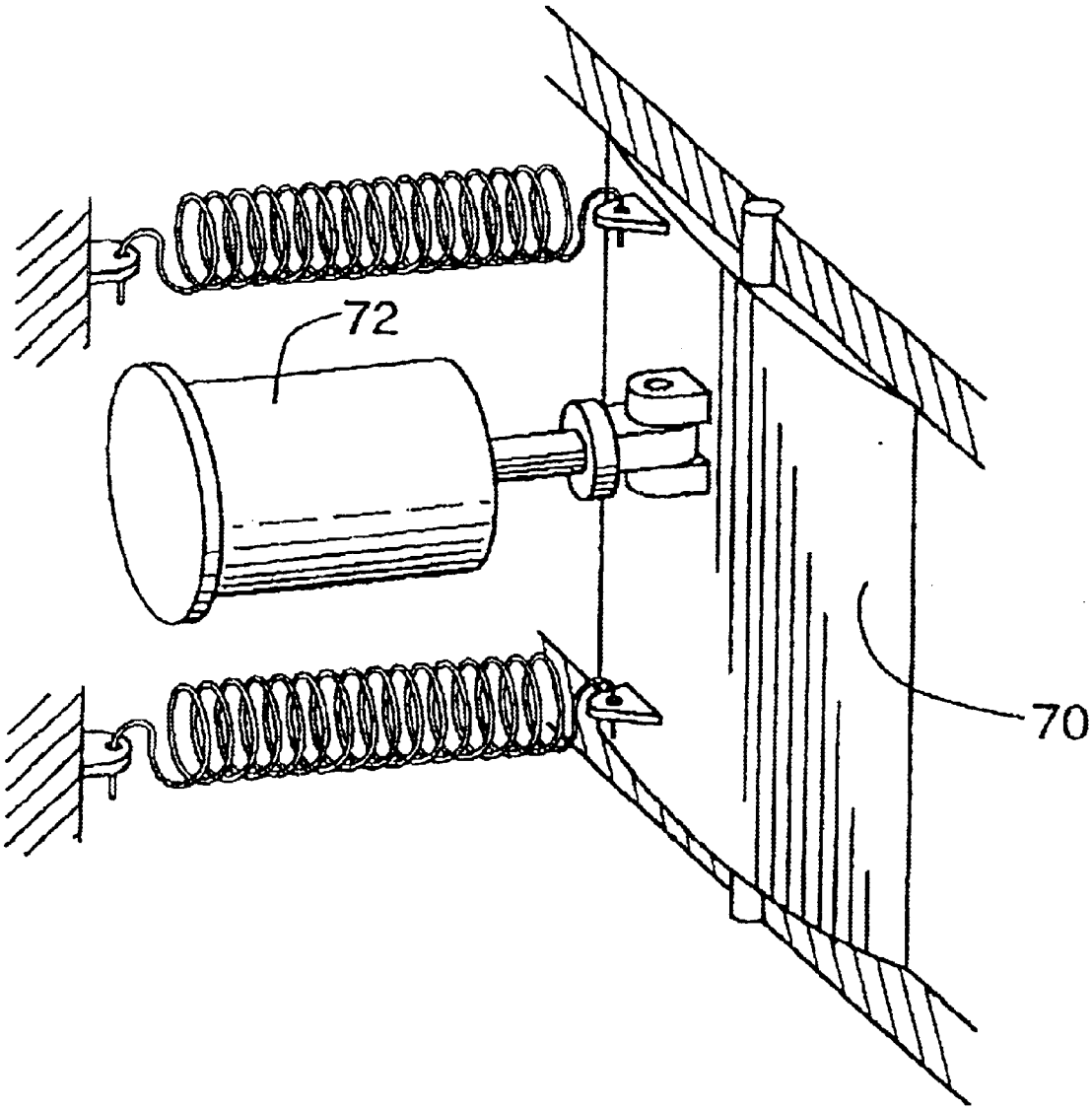
Figure 11:
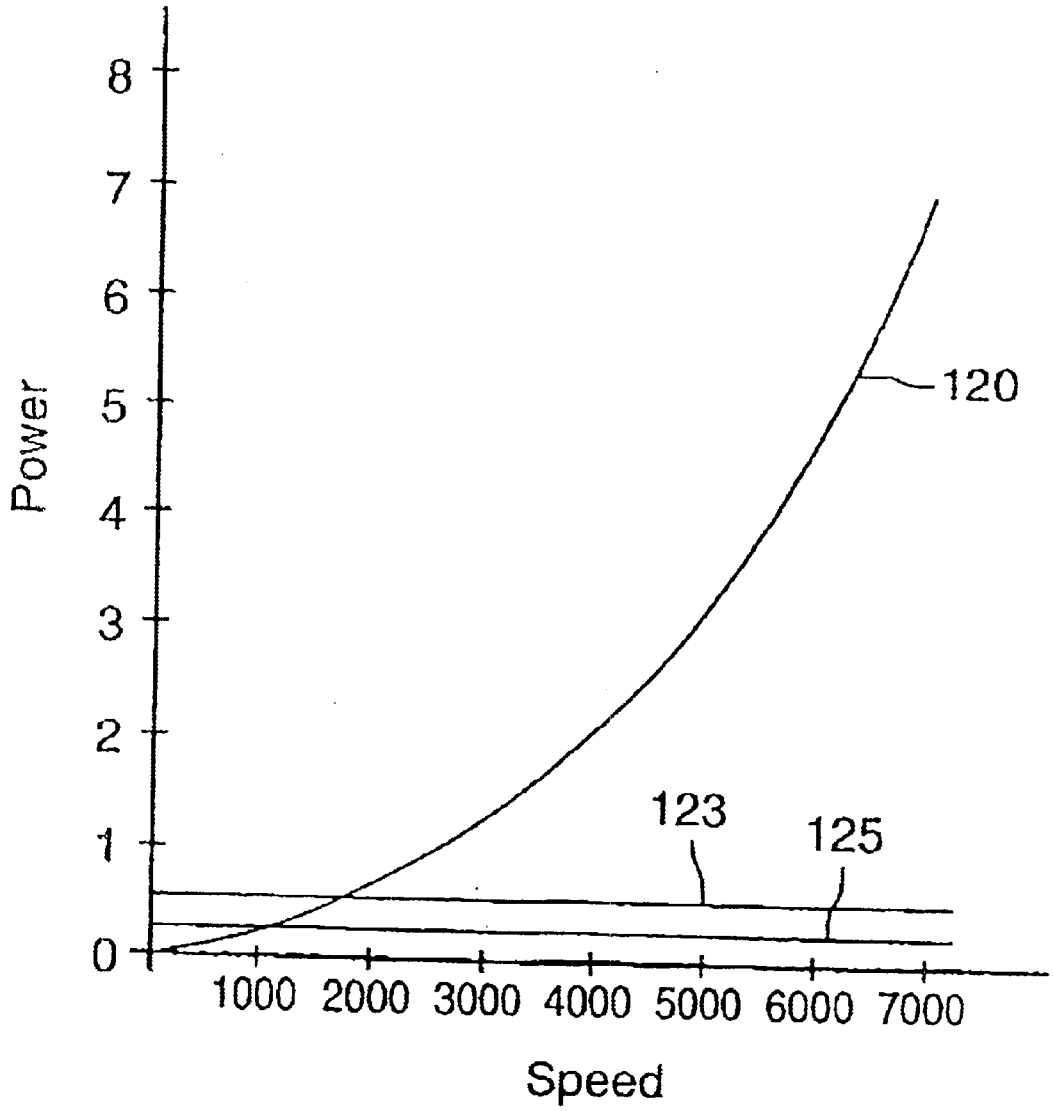
Figure 12:
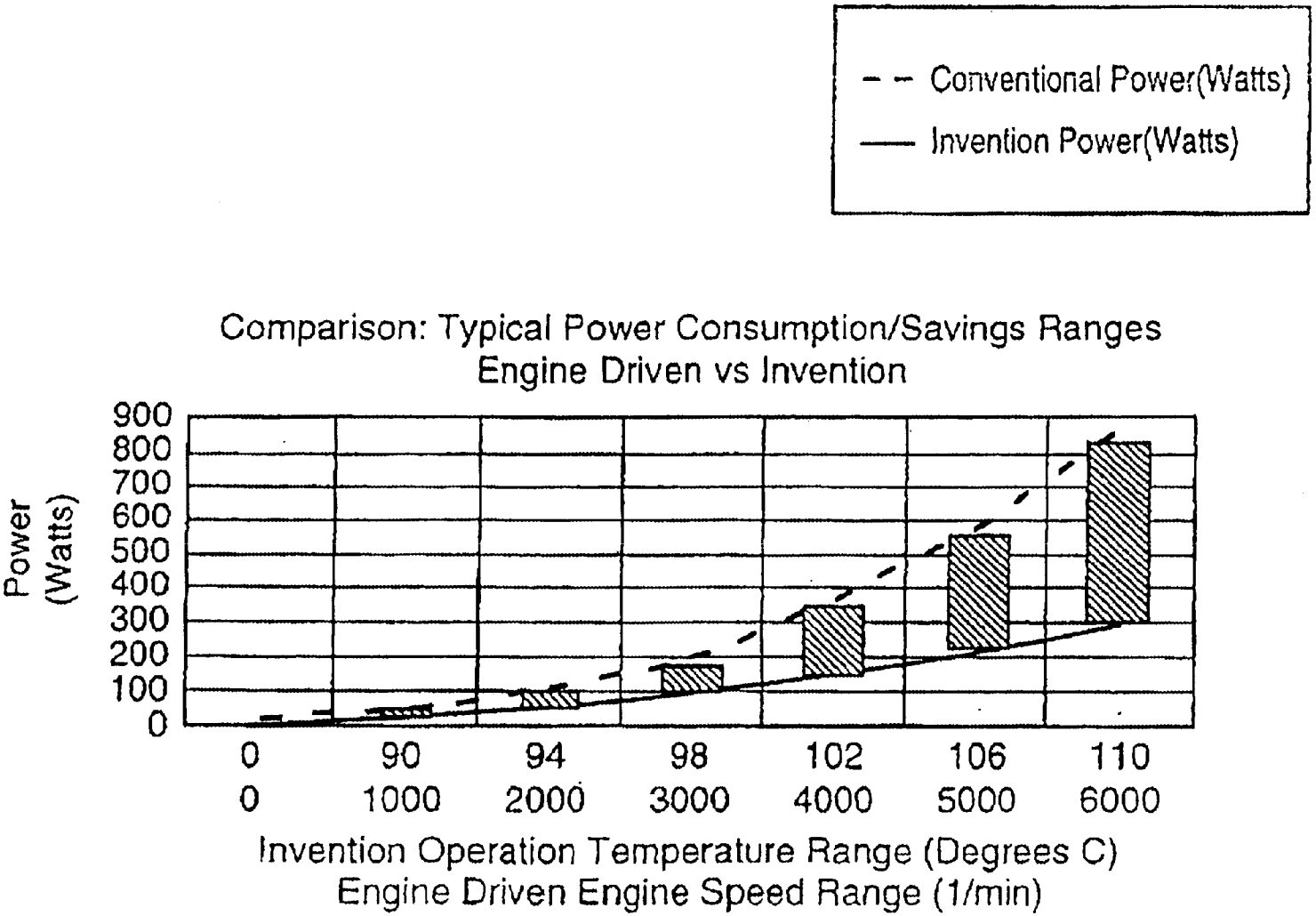

FIG. 2*a* is a close-up of an impeller of the pump;

FIG. 3 is a pictorial view in close up of the assembled components of the pump of FIG. 2;

FIG. 4 is a diagrammatic cross-sectioned side view of some of the components of the pump of FIG. 2;

FIG. 5 is an end elevation of some of the components of the pump of FIG. 2;

FIG. 6 is cross-section of another water pump which embodies the invention;

FIG. 7 is a cross-section on line A—A of FIG. 6;

FIG. 8 is a pictorial view of some of the components of the pump of FIG. 6;

FIG. 9 is a cross-section of another water pump which embodies the invention;

FIG. 10 is a plan view of some of the components of the pump of FIG. 9;

FIG. 11 is a graph showing a comparison of power consumption characteristics;

FIG. 12 is a graph showing a flow rate comparison.

Figure 13A:
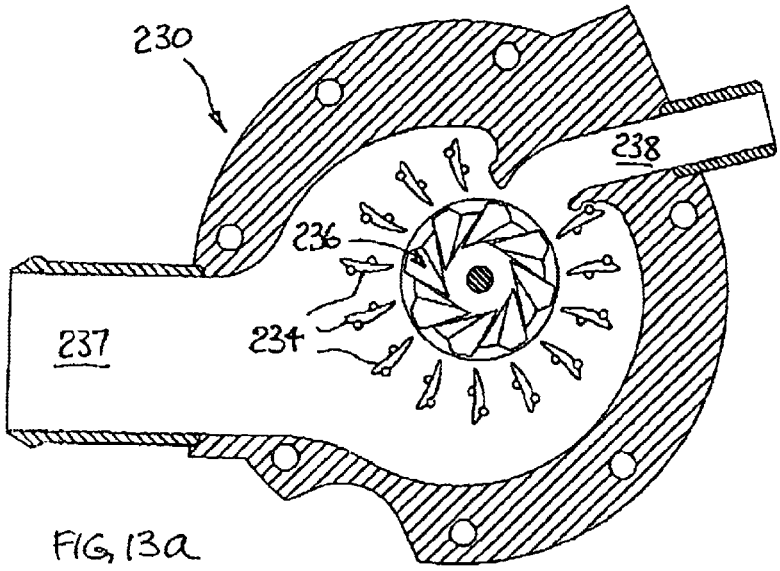
Figure 13B:
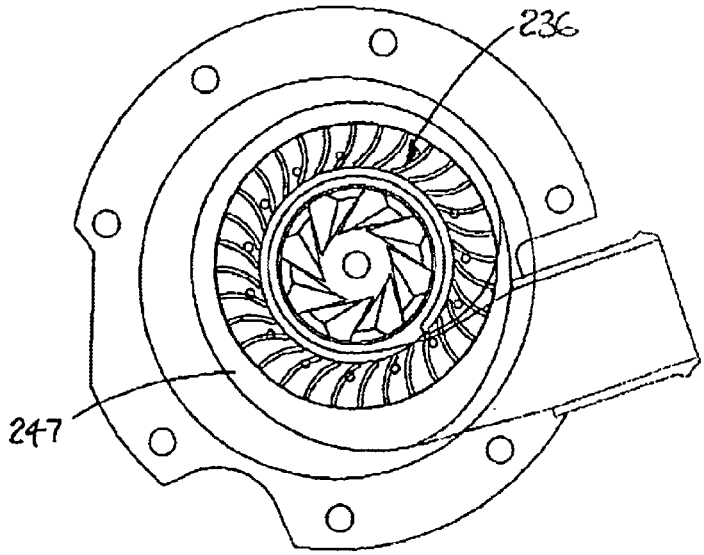
Figure 13C:
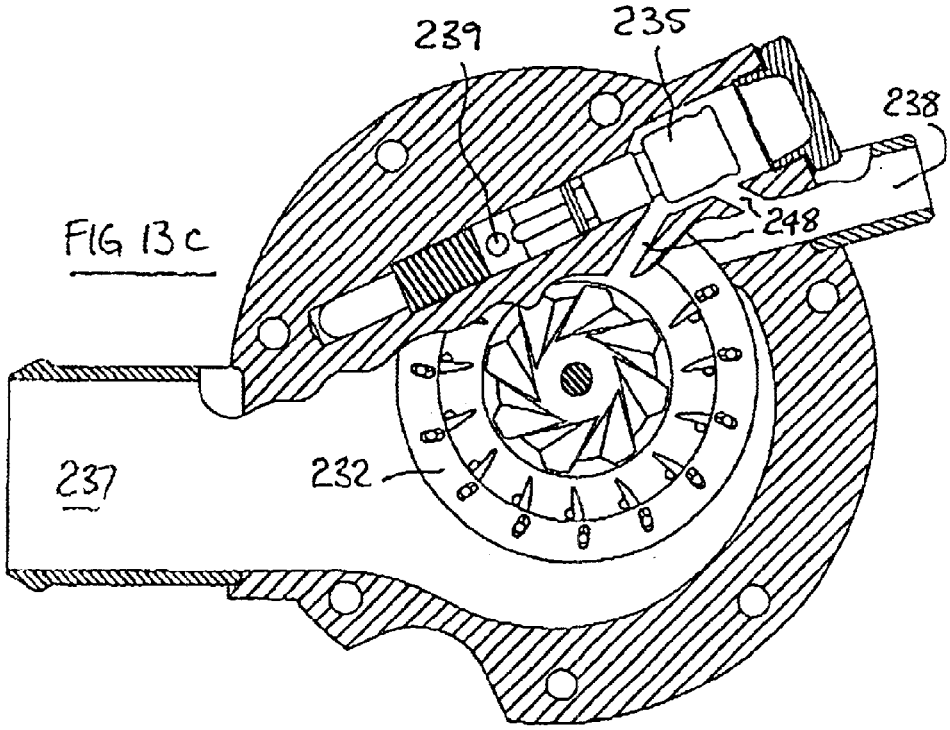

FIG. 13*a* is a sectioned plan view of a coolant pump for an automotive vehicle, the section being taken at the level of the swirl-vanes, showing inlet ports for conveying coolant into the pump from the radiator and from the engine/heater of the vehicle;

FIG. 13*b* is a section at the level of the impeller rotor, showing the outlet port for conveying coolant from the pump, back into the engine;

FIG. 13*c* is a section at the level of a thermostat actuator.

Figure 14:
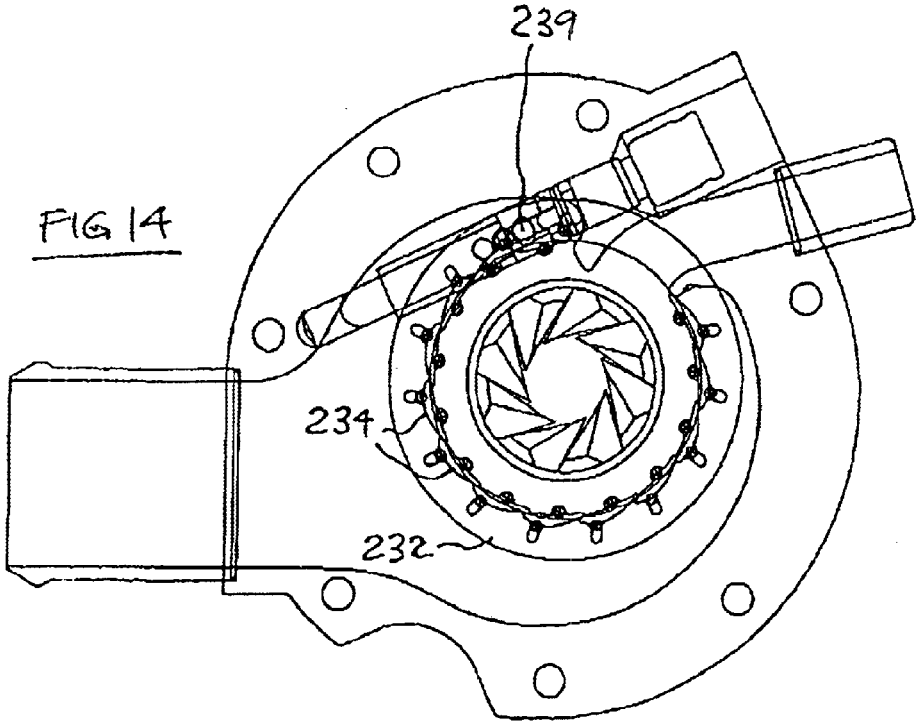

FIG. 14 is a composite of the FIGS. 13*a*, 13*b*, 13*c*, but shows swirl-vanes of the pump at a different orientation.

Figure 15A:
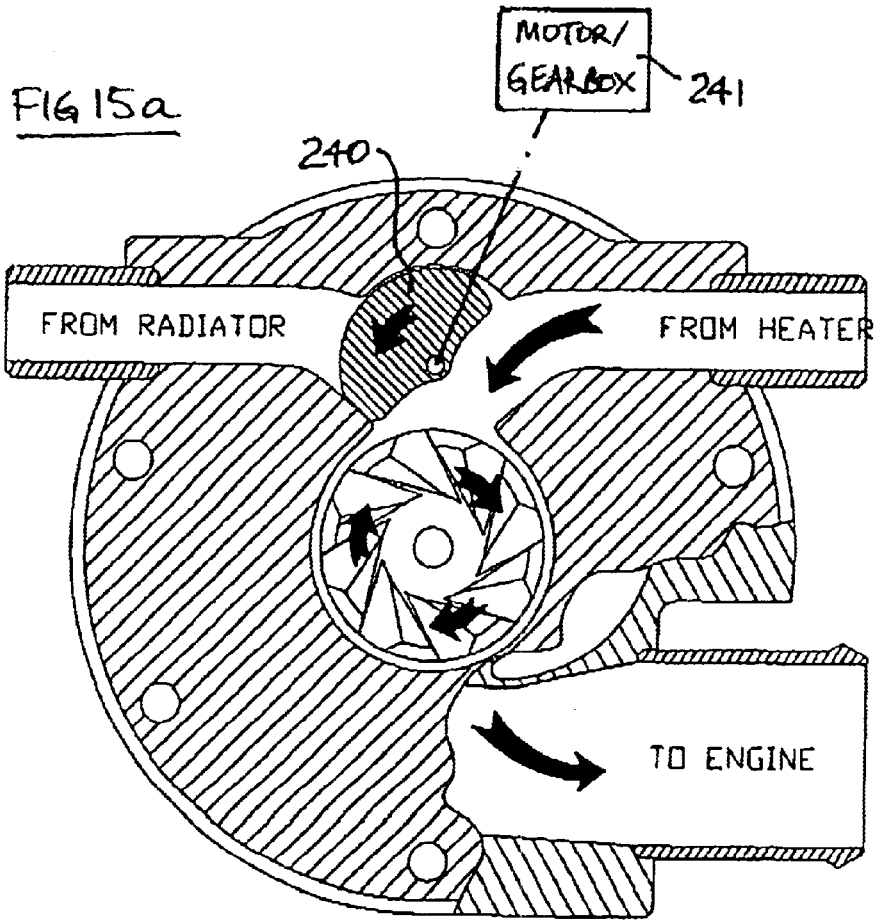
Figure 15C:
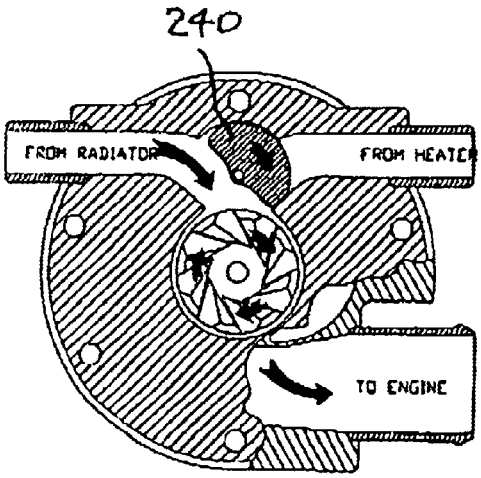
Figure 15B:
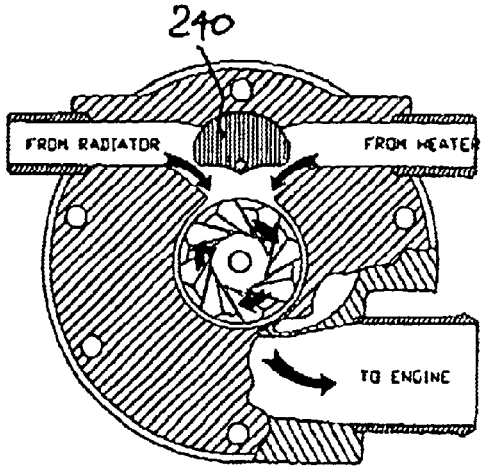

FIG. 15*a* is a section of view of another coolant pump;

FIG. 15*b* is the same section as FIG. 15*a*, but shows the pump in a different condition;

FIG. 15*c* is the same section as FIG. 15*a*, but shows the pump in another different condition.

Figure 16:
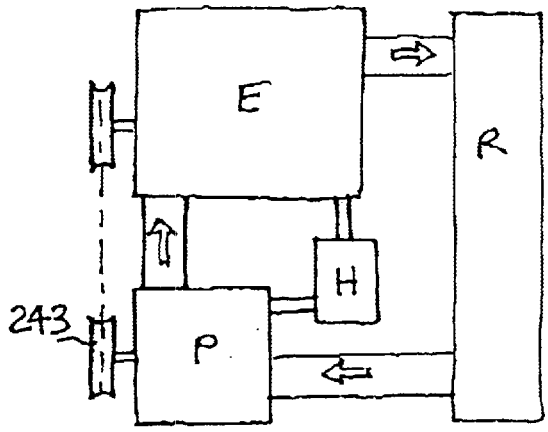

FIG. 16 is a block diagram showing some of the components of a typical coolant circulation system.

Figure 17:
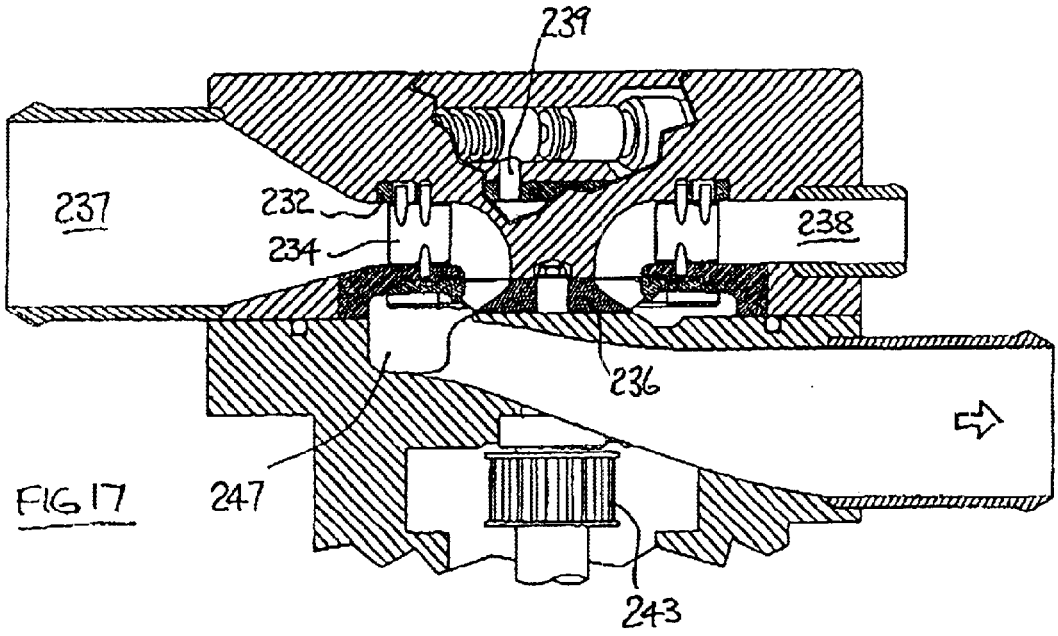

FIG. 17 is a cross-sectioned elevation of the coolant pump of FIGS. 13*a*, 13*b*, 13*c*, 14.

Figure 18A:
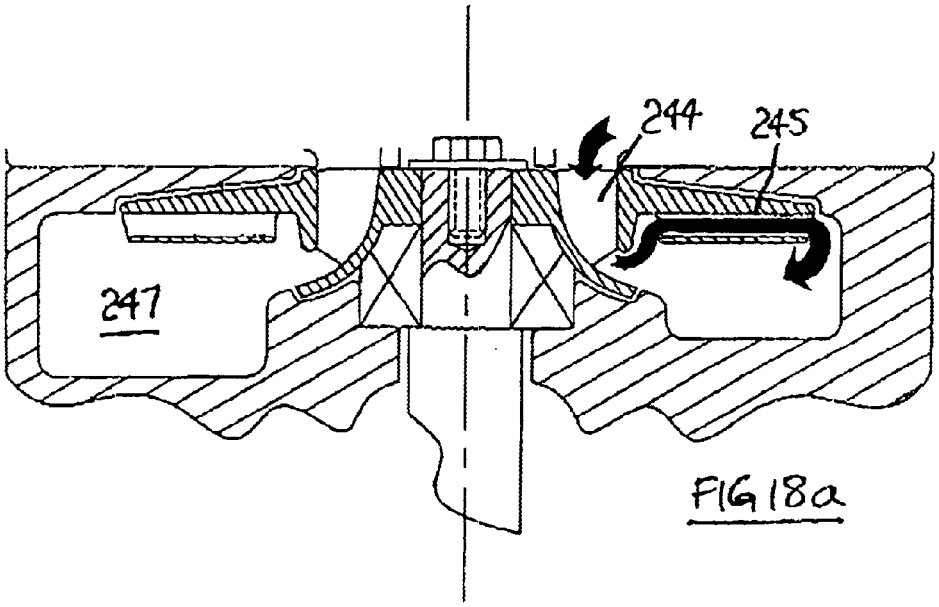
Figure 18B:
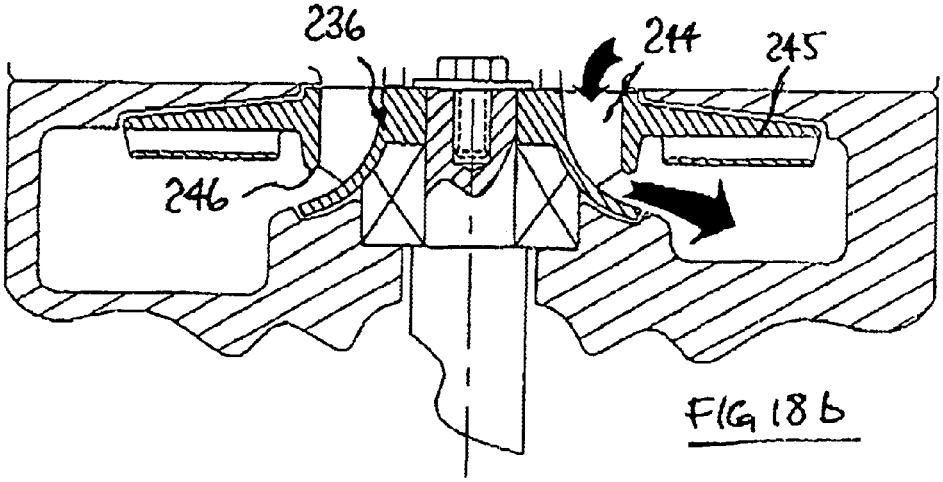

FIG. 18*a* is a portion of a view similar to FIG. 17 of another pump;

FIG. 18*b* is the same view as FIG. 18*a*, but illustrates a different condition.

Figure 19:
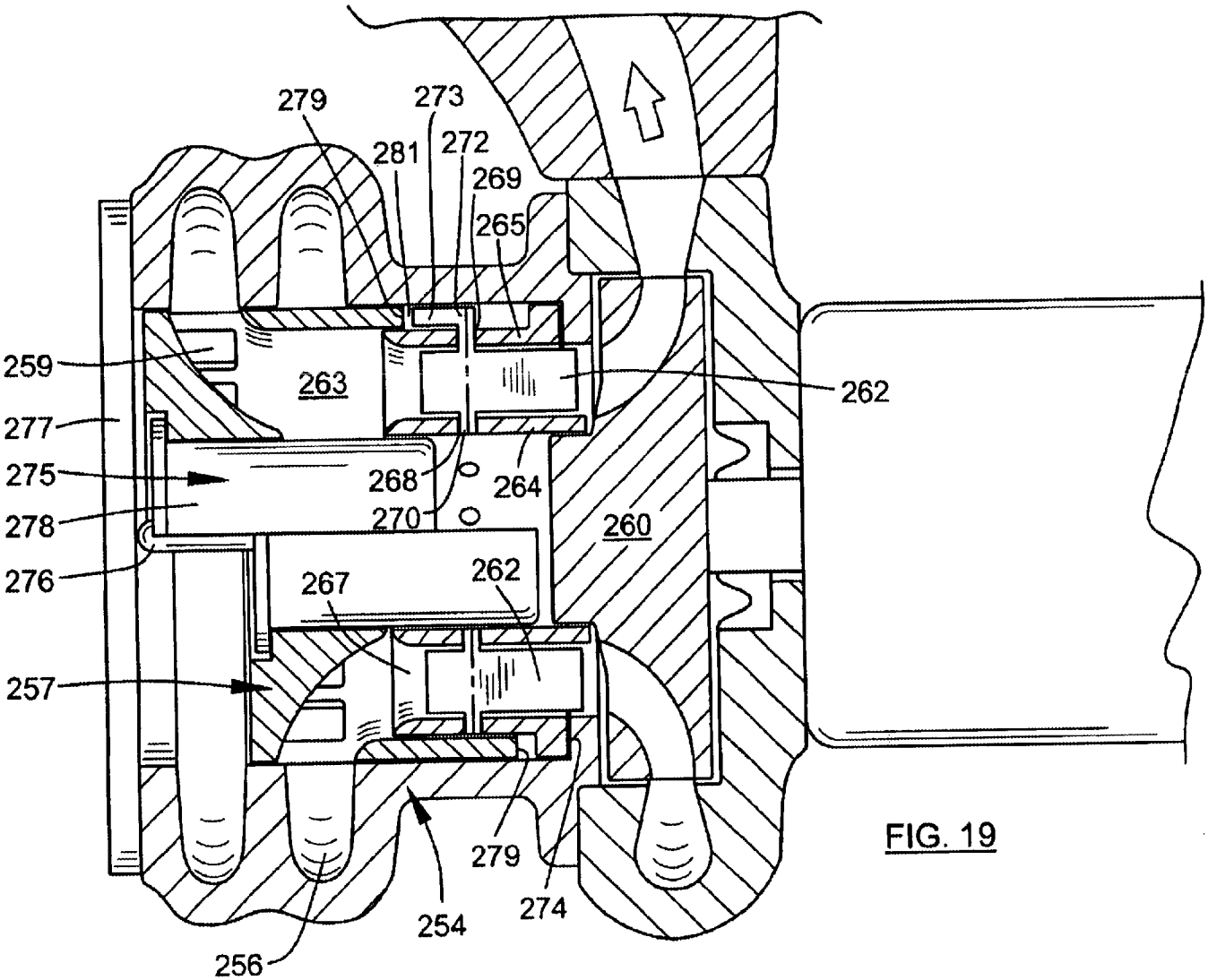

FIG. 19 is a cross-section of another coolant pump.

Figure 20:
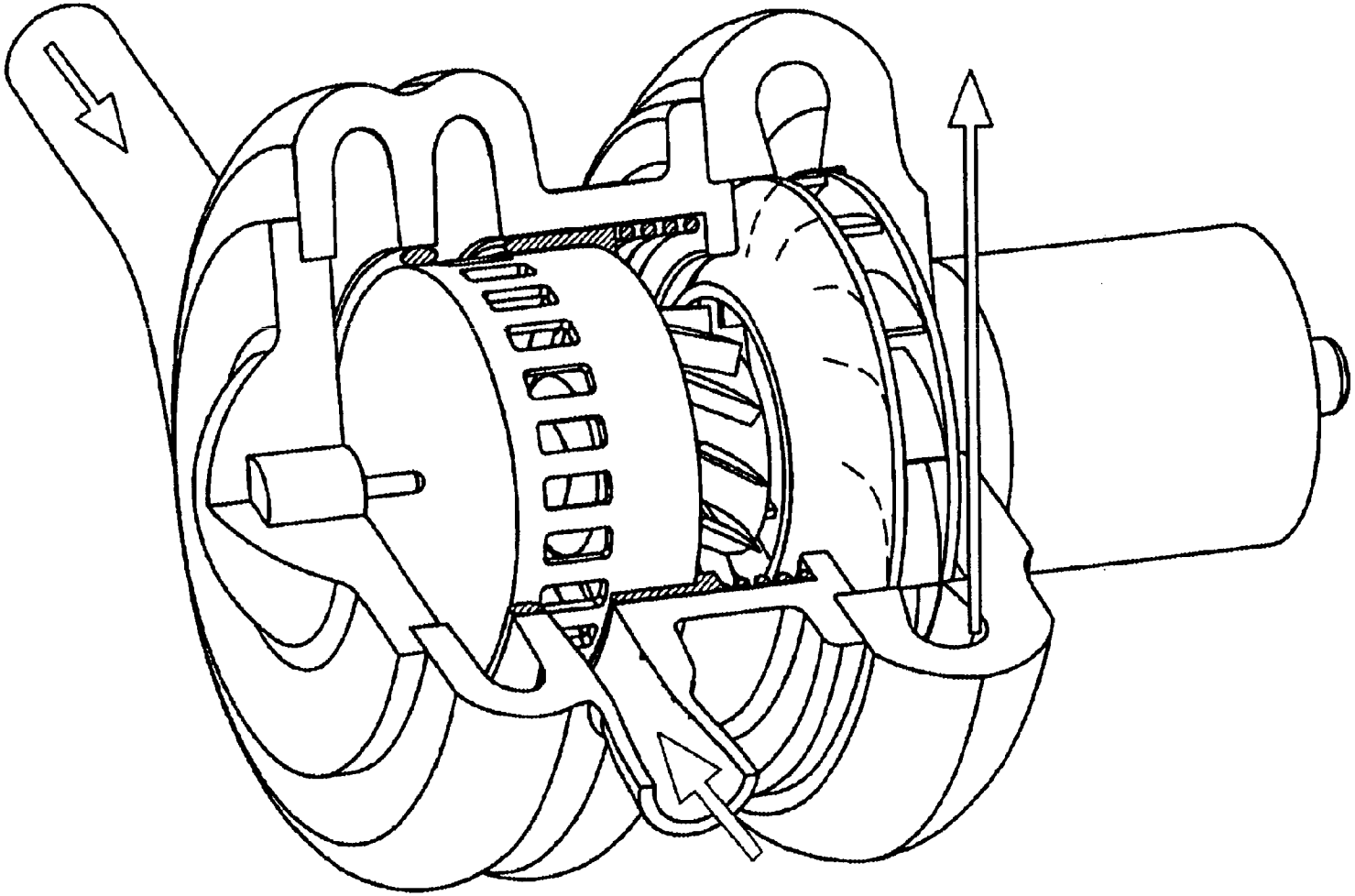

FIG. 20 is a pictorial partly-sectioned view of the pump of FIG. 19.

Figure 21A:
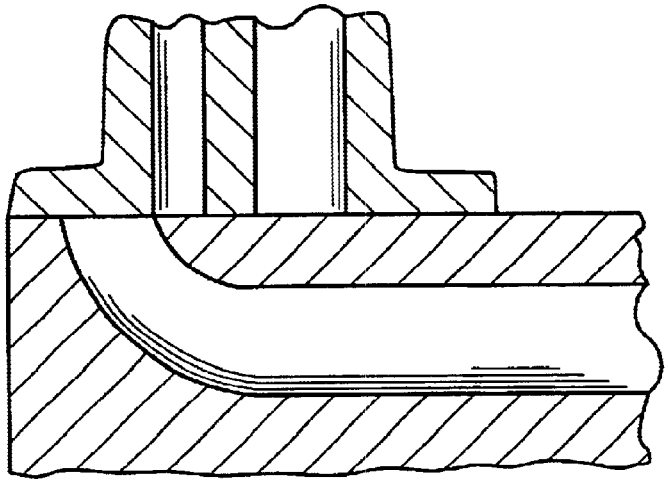
Figure 21B:
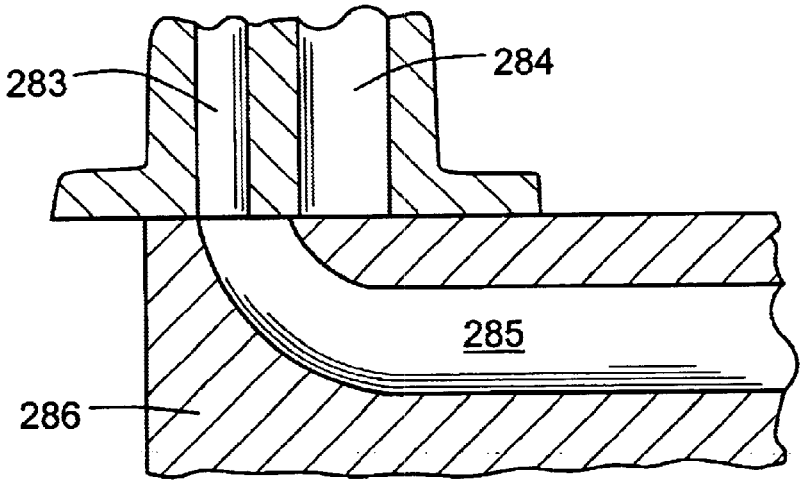
Figure 21C:
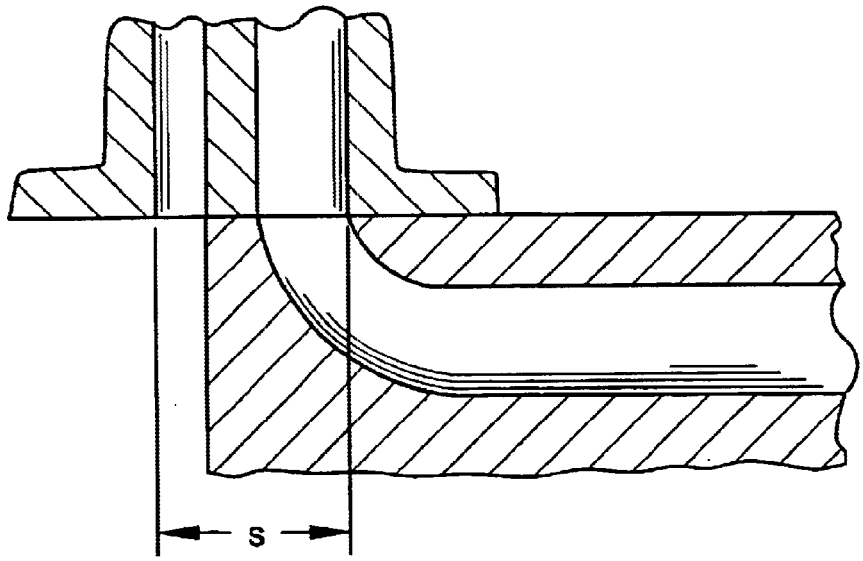

FIG. 21*a* is a diagram illustrating an operating condition of a coolant pump similar to that shown in FIG. 19;

FIG. 21*b* is the same diagram as FIG. 21*a*, except that the pump is in a different operating condition;

FIG. 21*c* is the same diagram as FIG. 21*a*, except that the pump is in another different operating condition.

Figure 22:
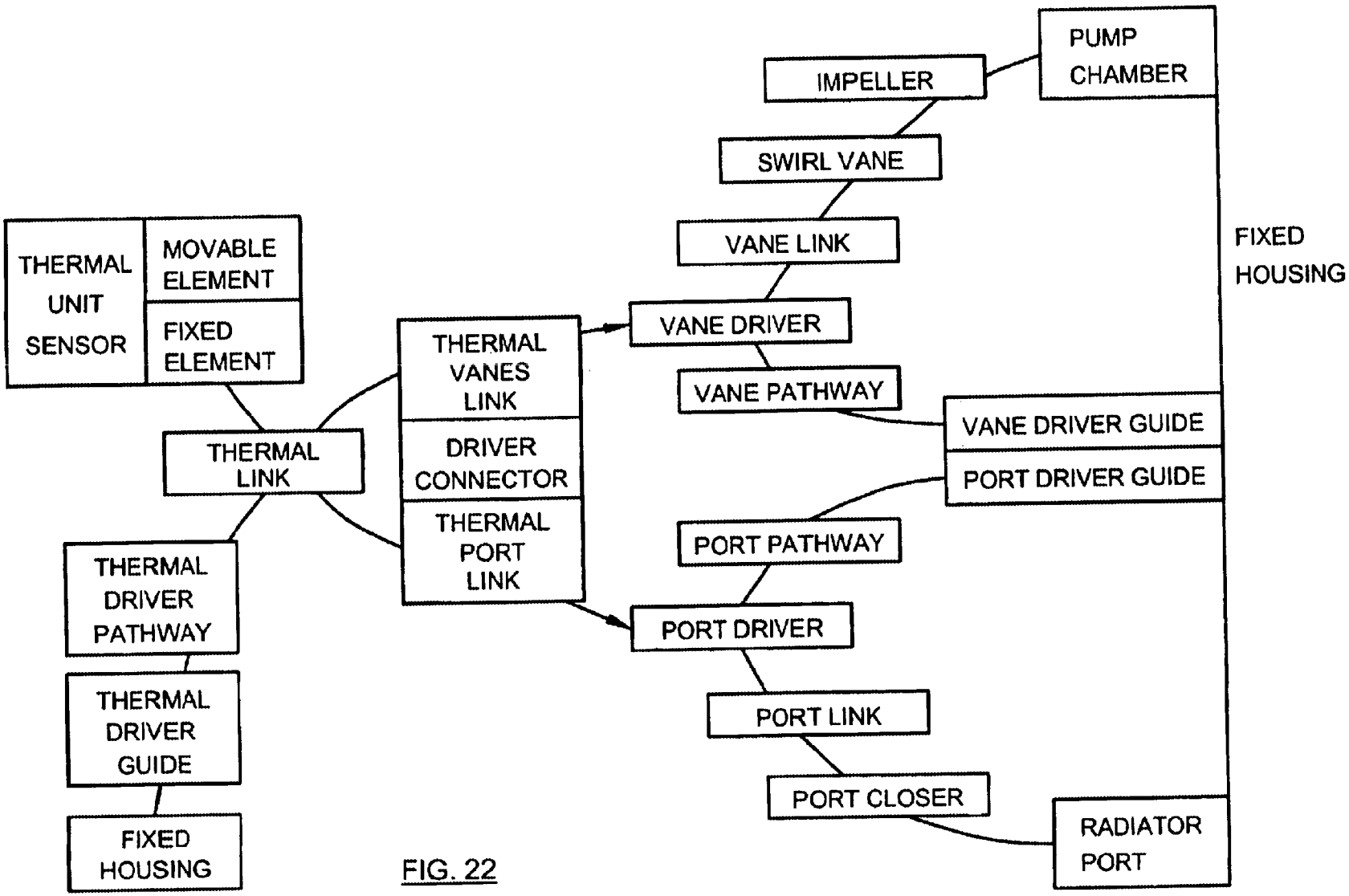

FIG. 22 is a diagram illustrating the manner of interaction of some of the constructional features of pumps that embody the invention.

Figure 23:
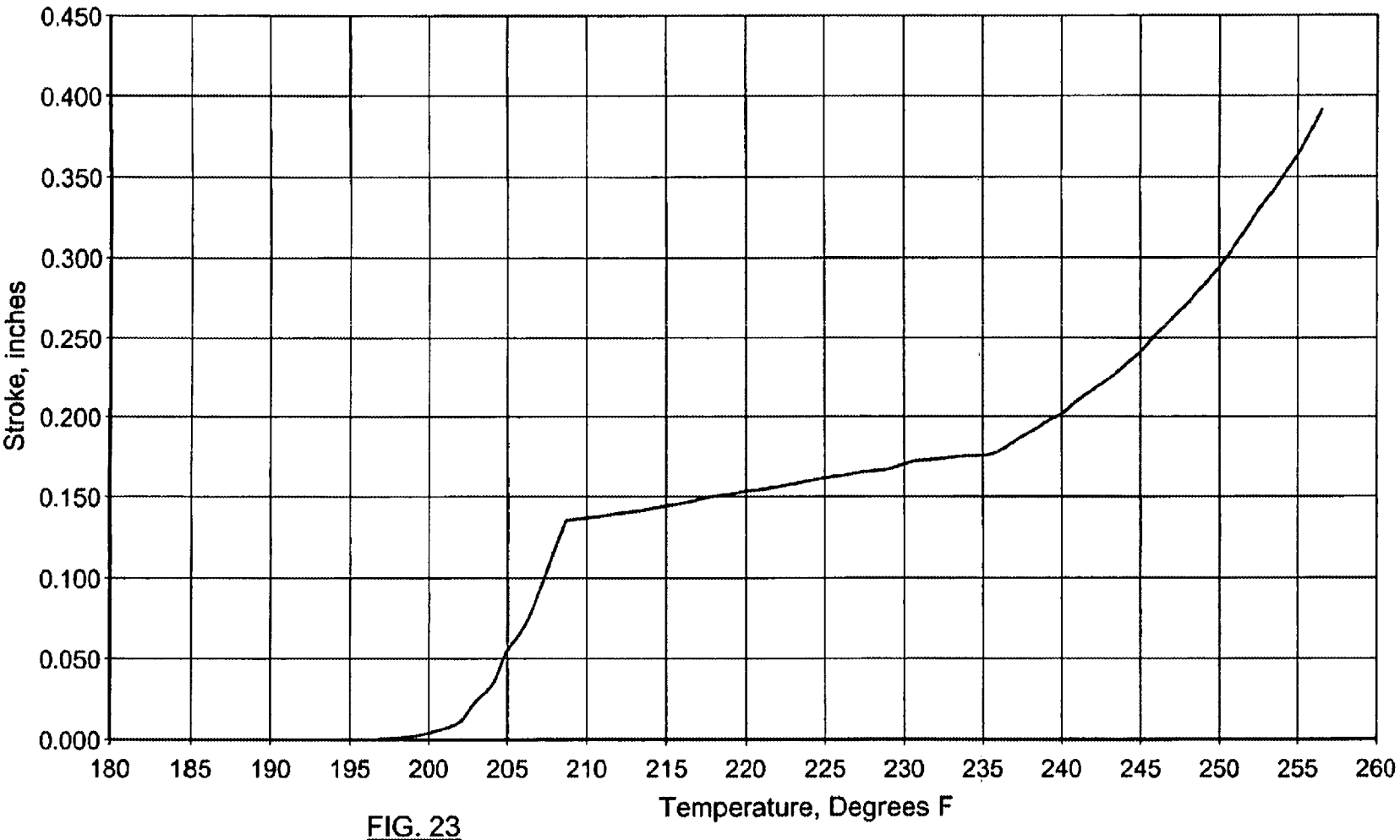

FIG. 23 is a graph showing a mode of operation of a thermostat unit that is suitable for use in the invention.

FIG. 24 is a Table showing some of the operating conditions of a vehicle, and the responsive conditions of the coolant pump.

Figure 25A:
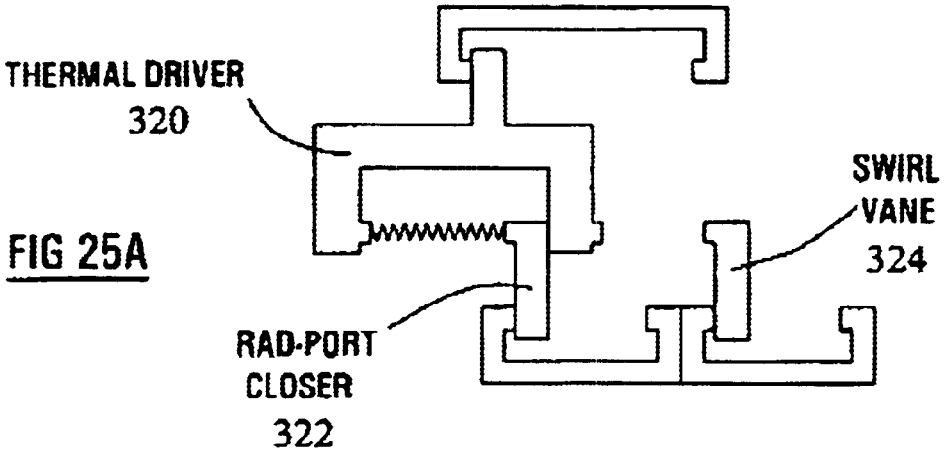
Figure 25C:
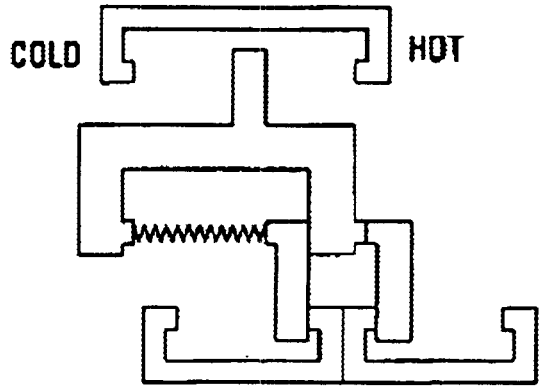
Figure 25E:
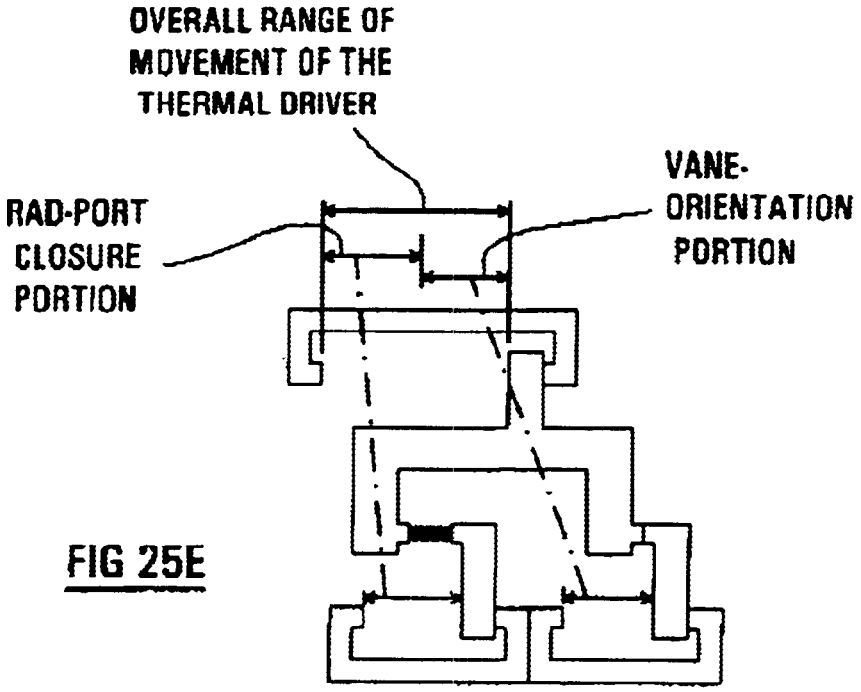
Figure 25B:
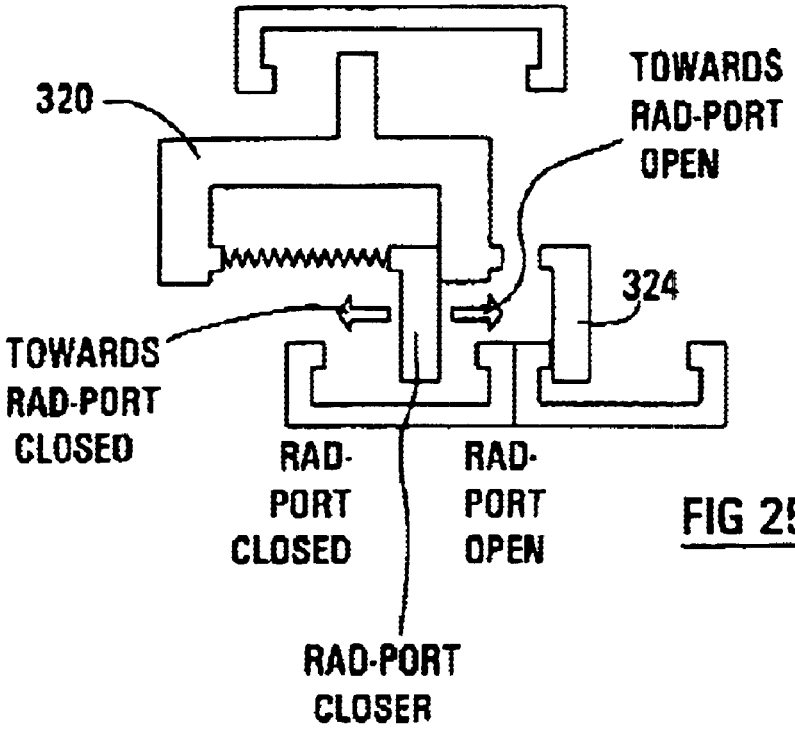
Figure 25D:
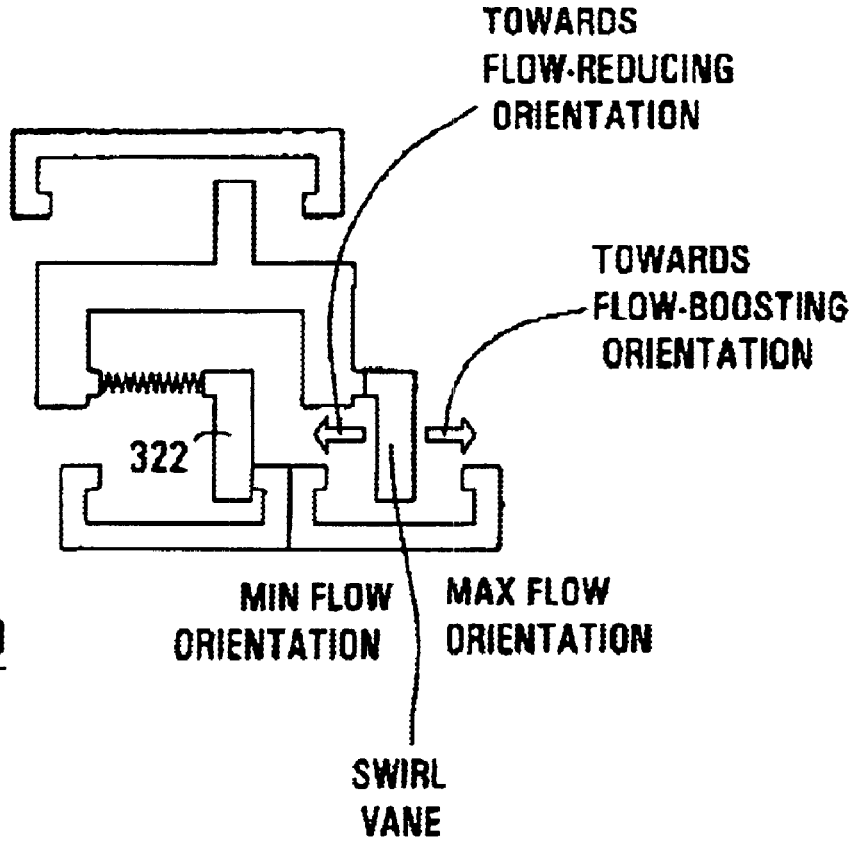

FIGS. 25*a*, 25*b*, 25*c*, 25*d*, 25*e* are diagrammatic representations for illustrating the movement of a thermal-driver of a coolant pump in relation to a radiator-port-closer thereof and a swirl-vane thereof;

FIG. 25*a* showing the positions thereof when the coolant is cold;

FIG. 25*b* showing the positions thereof when the coolant is cool;

FIG. 25*c* showing the positions thereof when the coolant is warm;

FIG. 25*d* showing the positions thereof when the coolant is hot;

FIG. 25*e* showing the positions thereof when the coolant is very hot.

Figure 26A:
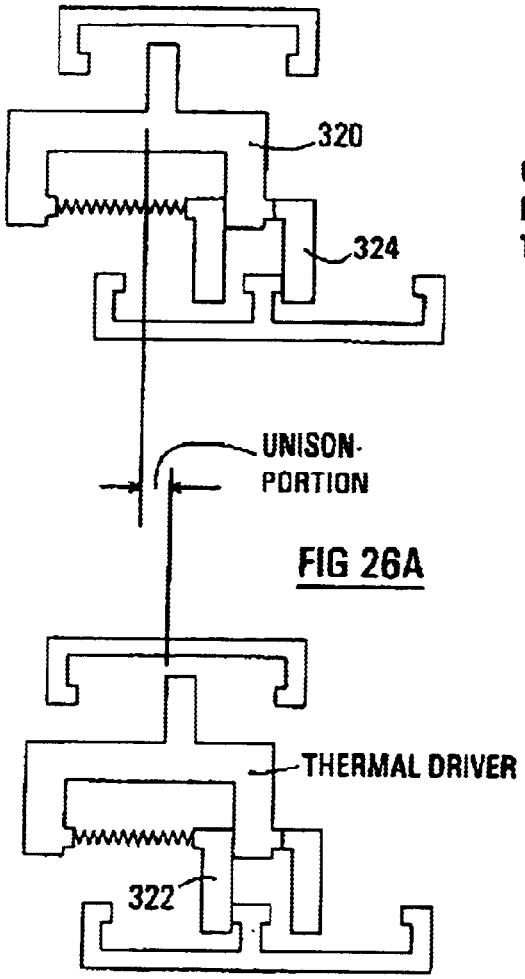
Figure 26B:
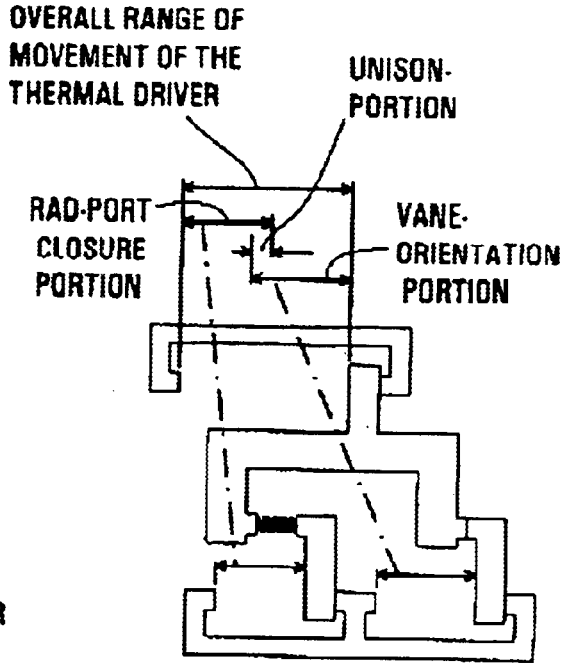

FIGS. 26*a*, 26*b* show an alternative to FIGS. 25*a*–25*e*, involving a unison-portion of the movement of the thermal-driver.

Figure 27A:
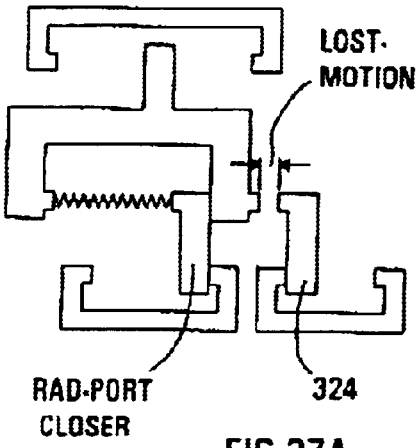
Figure 27B:
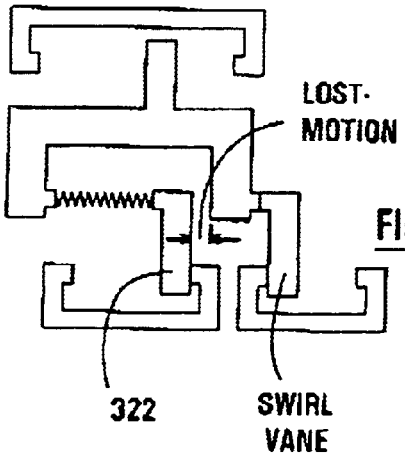
Figure 27C:
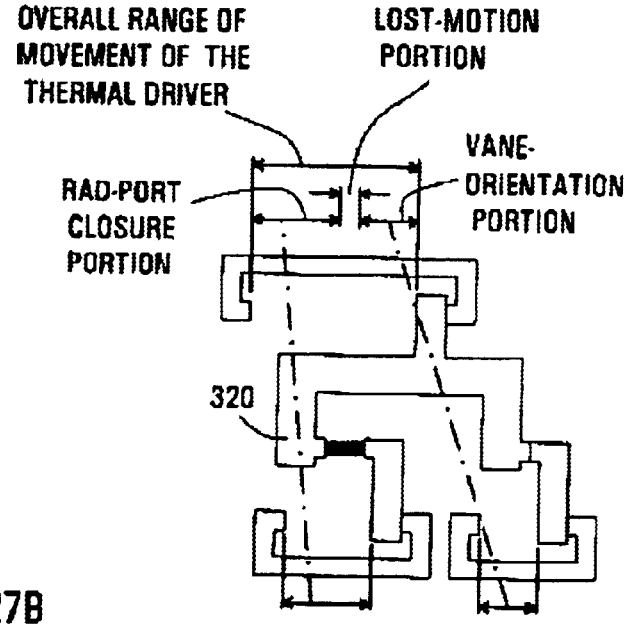

FIGS. 27*a*, 27*b*, 27*c* show another alternative to FIGS. 25*a*–25*e*, involving a lost-motion-portion of the movement of the thermal-driver.

The apparatuses shown in the accompanying drawings and described below are examples which embody the invention. It should be noted that the scope of the invention is defined by the accompanying claims, and not necessarily by specific features of exemplary embodiments.

Figure 1:
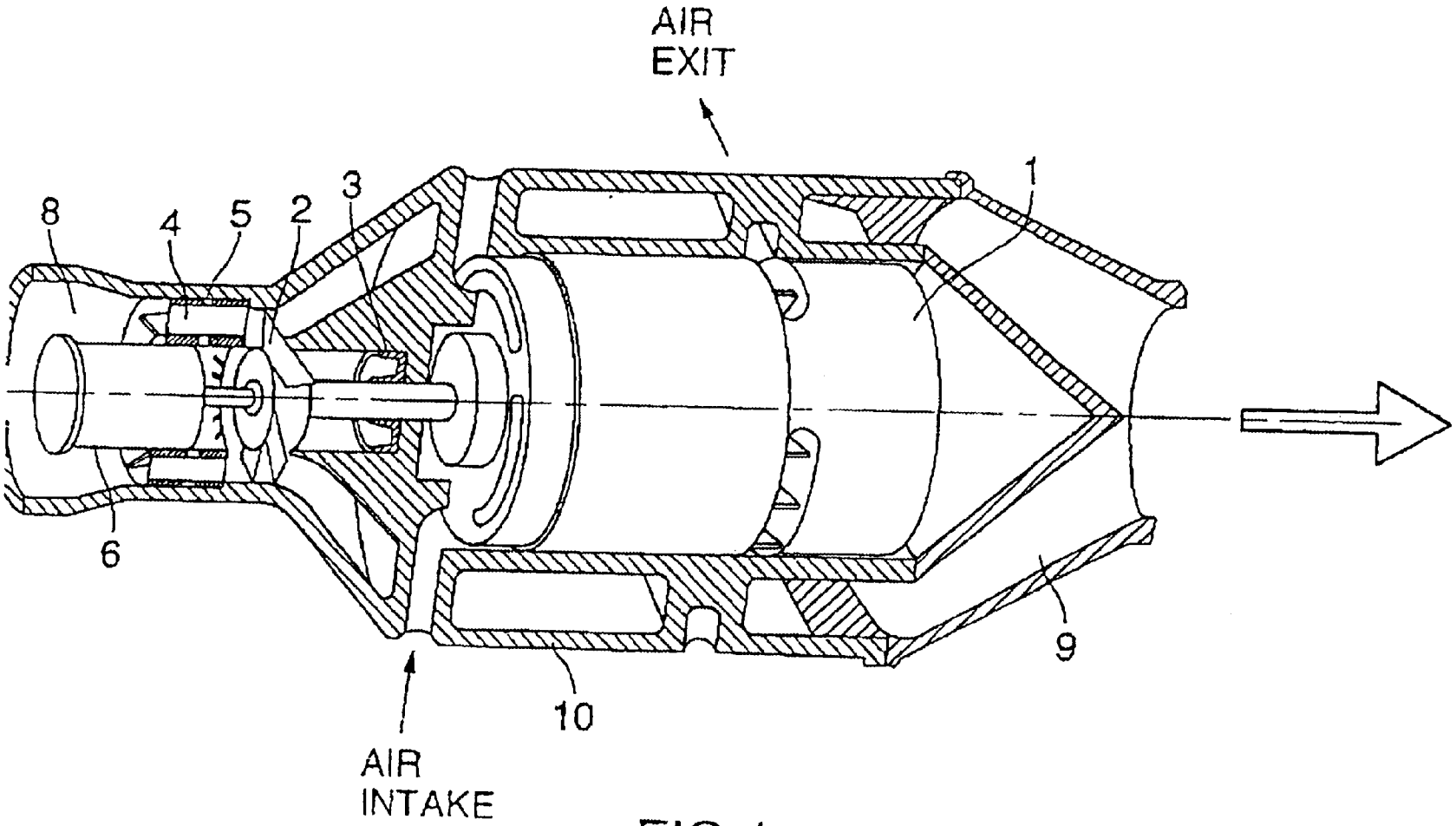
FIG. 1 is a pictorial cross-section of a water pump which embodies the invention.

As shown in FIG. 1, the motor 1 runs at a high speed, driving the impeller 2. A lip-seal 3 around the motor shaft seals the motor-pump interface between the motor 1 and the pump housing 10. The circular array of adjustable guide vanes 4 direct fluid flow from the fluid inlet passageway 8 onto the impeller 2. The impeller 2 then forces the fluid against the pump housing 10 towards the fluid outlet passageway 9.

The adjustable guide vanes 4 impart a variable degree of spin on the fluid flow depending on their angular displacement. The variable fluid flow spin ranges from negative to positive relative to the blades of the impeller 2. The degree of spin depends on the amount of angular displacement of the adjustable guide vanes 4. The angular displacement of the guide vanes corresponds to the amount of displacement of the guide vane linkage ring assembly 5. The guide vane linkage ring assembly 5 is displaced by the connected thermostatic element 6. Changes of temperature cause the thermostatic element 6 to expand or contract thus giving a corresponding displacement. A spring forces the thermostatic element 6 to return to its position of minimal displacement relative to its expansion-displacement force.

FIGS. 2–5 show an electrically driven water-pump that embodies the invention. The electric motor 20 is of the high speed (10,000 rpm or more) type, and typically draws a current, during normal operation, of between about 10 and 20 amps (at 12 volts). The body of the motor is bolted to a mounting plate 23. The shaft 25 of the motor is secured to a rotary impeller 27. The Impeller 27 is shown in FIG. 2*a*, and is constructed preferably as a plastic or metal moulding.

The impeller 27 is placed in the path of coolant water flowing from the engine block via entry-passage 29. Water passing through the impeller is channelled away via exit-passage 30 (and thence passes to the radiator, etc).

Before reaching the impeller 27, water entering the impeller 27 first encounters a set of movable vanes 32. The designer provides that the vanes might be inclined in a sense whereby the vanes induce a rotary swirling motion into the water flow as the water flow enters the impeller. The vanes might be inclined in a first sense such that the swirling induced by the inclined vanes is in the same sense as, and reinforces, the rotary swirling produced by the impeller itself; or, the vanes might be inclined in the opposite sense, in which case the swirling induced by the vanes serves to oppose the swirling produced by the impeller.

By controlling the inclination of the blades, the output characteristics of the pump impeller can be controlled, in a smoothly progressive manner, and while the electric motor keeps the impeller rotating at more or less constant speed.

The inclination of the vanes is controlled by means of a thermostat 34, as will now be described.

Each vane 32 is secured to a respective vane-shaft 36, which is guided for rotation in a respective radially-disposed bore 38 in a fixed base plate 40. The outer end of each vane-shaft 36 carries a respective lever 43, by means of which the shaft 36, and the vane 32, may be rotated.

The shaft-levers 43 are caused to rotate by the action of a rotor-ring 45. The rotor-ring 45 is mounted for rotation on the fixed base-plate 40. In fact, the rotor-ring is sandwiched between the fixed base-plate 40 and a fixed cover-plate 47. The two fixed plates 40, 47 are bolted (at 46) to the mounting plate 23. The plates 40, 47 are held apart by spacers 44, and the rotor-ring 45, which lies between the fixed plates, is movable relative thereto. The rotor-ring 45 is biassed in the anti-clockwise sense by means of springs 48.

The rotor-ring 45 is provided with notches 49, one for each of the shaft-levers 43 (five in this case). When the rotor-ring rotates, the five shaft-levers are dragged around and made to rotate their respective shafts 36 in unison with each other.

The rotor-ring 45 is caused to rotate by movement of the stem 50 of a thermostat 52. The distance the stem 50 protrudes from the body of the thermostat is proportional to the temperature of the water flowing over the body. The rotor-ring 45 thus rotates through an angle which is proportional to the temperature of the water, and similarly, the movable vanes 32 thereby lie at an angle of inclination which is proportional to the temperature of the water.

The thermostat 52 is of the type which contains an expandable body of wax. Such thermostats are readily available in a body size around 13 mm diameter, where the stem moves through approximately an 8 mm working stroke, between hot and cold. The movement of the stem is more or less proportional to the temperature, over the working stroke.

The thermostat is arranged to move the movable vanes 32, in this case, from an angle of about 50 degrees of with-the-impeller bias to an angle of about 25 degrees against-the-impeller bias. With-the-impeller bias is used to reduce the operation of the pump, whereby the pump delivers a smaller volumetric flow, and uses a smaller input energy; this is of use when the coolant is at cooler temperatures. Against-the-impeller bias is used to boost the flow of water through the pump impeller, which is of use when the water is starting to overheat.

The electric motor runs continuously while the engine is running, even when the engine coolant flow is at a minimum. Of course, the minimum coolant circulation flow is, and must be, a substantial flow: if the flow were allowed to approach zero flow conditions, the engine would quickly overheat.

In fact, one of the reasons a movable-vane system, as described, is so advantageous, is that the movable-vanes, even at the position where the flow is reduced to the maximum extent, still do permit a substantial flow. In the movable-vane system, the required flow adjustment is between two extremes of flow where even the lowest required flow is a long way from the zero flow condition. The movable-vanes system may be regarded as making it possible to make fine-tuning adjustments to what is a relatively large flow, in a refined and controllable manner, as distinct from switching a flow between on and off. Generally, it is regarded as quite demanding to obtain good linear control of a flow from, say, 60% of maximum, upwards. The movable-vane system does give excellent control and linearity over that range. It is recognized that this is just the characteristic that is required in an automotive water pump.

The mounting plate 23 includes cooling air passages, whereby the flow of cooling air over the motor is maximised, which is advisable in the case of a continuously-running motor. The flow of water emerging from the impeller passes radially outwards into the chamber 54. The mounting plate 23 includes fixed spacers 56, which provide space for the coolant to flow around and out of the passage 30.

The motor-shaft 25 carries a seal 58. The seal 58 must be designed for high shaft speeds: however, because the shaft diameter is small (e.g 5 mm) the rubbing speed of the shaft on the seal is small, and in fact the seal 58 can be expected to have an adequate service life (as that expression is used in relation to automotive seals). The designer may prefer to provide a mechanical (rubbing) seal in place of the lip seal, if problems with lip-seals are feared. Another alternative is to provide a magnetic drive coupling from the electric motor to the impeller. Magnetic-drive couplings, which avoid the need for seals, are commonly available, and are not expensive, in the size of drive herein described.

FIG. 6 shows another type of water pump, which embodies the invention. In this case, water from the engine enters the pump at port 60, and leaves through port 63. The incoming water flows around an annular passage 65 (FIG. 7). The electric motor 67 driving the impeller 69 is located internally of the annular passage 65.

The vanes induce a degree of rotary swirling motion of the water passing through the annular passage 65, as the water approaches the rotating impeller 69 (upwards in FIG. 6). The water flow can be biassed to swirl clockwise or anticlockwise in the annular passage 65, depending on the orientation of movable vanes 70. As shown in FIG. 7, the vanes are inclined to the left, whereby the water flow is biassed clockwise. Flow through the impeller 69, with the electric motor 67 set in the normal rotational sense, will be enhanced by a clockwise-biassed water flow. Inclining the vanes 70 to the right (FIG. 7) would reduce the water flow through the impeller, for a given speed of the motor. Again, even when the flow is reduced to a maximum extent, the flow is still substantial. The thermostat 72 senses the temperature of the flowing water, and adjusts the angle of the vanes 70 accordingly.

FIG. 8 shows how the thermostat 72 is configured so as to control the angular movement of the movable vane 70. The other vanes are linked by suitable connecting rods.

The FIG. 6 structure is suitable for fitment, as an insert, into the hoses which convey water on an automotive engine. As such, the unit may be fitted as a repair to a vehicle with a damaged water pump of the traditional belt-driven type. Alternatively, the FIG. 6 configuration may be incorporated as an OEM water pump.

FIGS. 9, 10 show another water pump which embodies the invention. The thermostat 89 acts upon a rotatable ring 90, in which are carried several movable vanes 92, mounted on spindles. The vane spindles terminate in respective tags 94, which engage corresponding slots 96 in the pump housing 98. Movement of the thermostat stem is effective to drag the ring around, and cause the vanes to rotate to a new orientation.

In some cases, the vanes are positioned in the flow of water leaving, rather than entering, the impeller. This gives a somewhat different characteristic of speed/motor-current/pressure/flow-rate/efficiency/etc. but one which may be more appropriate in some circumstances.

In the graph of FIG. 11, curve 120 shows the estimated power consumption of a typical conventional fixed-ratio, engine-driven coolant pump system, with the engine thermostat open. Curve 123 shows the estimated power consumption of a movable-vane, electric-motor driven pump system, of the type as described herein, in which the coolant flow-rate is boosted by the vanes. Curve 125 is of the same thing, in which the flow rate is reduced by the vanes. The new system can provide a constant coolant flow rate, independent of engine speed, even down to zero engine speed: in the new system, the flow rate changes in response to a charge in temperature of the coolant, and the new system is arranged to increase or reduce the flow-rate of the coolant as the temperature goes up or down.

FIG. 12 is another graph showing an estimation of the improvement of the new pump system over a conventional system.

Some further benefits of the coolant flow control systems as described herein will now be described.

1. Improved control of engine temperature. Most conventional engine driven systems rely on fan-airflow modulation of the airflow across the radiator to maintain engine coolant temperature within a specified operating range. Controlling the temperature within tight limits allows overall engine efficiency to be improved. Minimizing the temperature operating range is a design objective because of the inherent engine performance benefits associated with operation at optimal temperatures, such as better combustion etc. Also, the tighter control of coolant temperature by the new pump system may be expected to lead to a reduced need for modulation from the fan.

2. Coolant pump efficiency. The amount of energy spent on cooling, aggregated over the entire operating range, is considerably reduced.

3. Improved heater performance. At idle, conventional engine-driven pumps commonly deliver insufficient coolant to the heater-core resulting in poor cabin heater performance. The new system can be designed to at have a minimum flow-rate tuned for a given system resistance and higher flow through the heater core to boost cabin heater performance during warm-up.

4. After-run cooling capability. An electrically driven pump, as depicted herein, can be switched to provide after-run cooling. After-run cooling occurs when the engine is shut down and therefore cooling cannot be provided by means of an engine-driven pump. A simple thermal switch similar to that used for the switching off a conventional cooling fan could be employed here. After shutdown, when engine-driven pumps no longer function, conventional engines sometimes experience a large temperature rise referred to as after-boil, even though the electric cooling fan may still be running, to cool the radiator: the residual heat is present in the engine block and head, not in the radiator. Excessive after-boil can cause premature deterioration of components and fluids. Some engines have even had special electric coolant pumps fitted, in addition to the, conventional belt-driven coolant pump, just to keep the coolant circulating for a few minutes after the engine stops. Similarly, if an engine is fitted with a cold weather pre-heater to warm the engine prior to starting, an electric pump is advantageous in that it can be switched on to circulate the coolant prior to starting.

5. Cost advantages. A conventional water pump requires a belt drive, robust bearings, and generally an elaborate and costly infrastructure, although the pump itself is quite cheap. Also, the conventional system is labour-intensive on the assembly line. The present system, as a pre-manufactured self-contained unit, is simply bolted onto the engine block, and requires virtually no other assembly-line work. The unit also is lighter in weight overall than the belt-driven unit. A high-speed, low-torque drive (which are the characteristics that lead to lightness) is simple with an electric motor drive, but not possible with a belt drive.

6. Versatility. A conventional water pump is restricted as to its mounting position and manner of driving. The new pumping system may be configured to be installed by bolting it to the engine block, or the unit may be configured to be inserted into the plumbing arrangements of the engine. The motor driving the new system preferably is constant-speed, as described; all the variation in flow being derived from varying the orientation of the vanes. But the system could be configured to utilise a two-speed or multi-speed motor, or even a steplessly-variable-speed motor if the needed sophisticated controls are included.

7. Range of operation. Typically, an automotive engine requires the coolant flow to vary between about 10 and 30 gallons a minute. The system as described can provide that level of flow, and that variation in the level of flow, in an inexpensive, self-contained unit.

8. Reliability. The system as described herein is intended to replace the belt driven coolant pump, not to supplement it. Modern electric motors, even high-speed designs, are very reliable. By contrast, a conventional belt-driven water pump, in order to reach its present state of acceptable reliability (i.e reliability in the very demanding automotive sense), has had to be over-engineered to a considerable degree. Of course, electrical components can fail, and a failed water pump can quickly lead to engine damage. But the outcome of a reliability comparison between an electrical component that runs at more or less constant speed, and a mechanical belt drive, is all too clear. Wax-type thermostats are cheap, and very reliable. In the case where the vane orientation is operated by an electronic engine-management system, it is noted that such systems are becoming increasingly reliable, and the systems as described herein are able to take advantage of that (which a mechanical belt-drive is not).

In this specification, it has been suggested that the electric motor may run at constant speed. However, this is not to say that a real, practical motor, does indeed operate at constant speed. Rather the emphasis is that the invention provides a means for controlling the flow of coolant, wherein the flow is controlled by a means other than by controlling the speed of the pump. That is to say, the motor and the pump are enabled to run at constant speed, and still the flow rate of the coolant can be varied. Whether or not the speed of the motor actually is constant depends on the characteristics of the motor. The conventional type of 12-volt DC motor currently in widespread use for operating accessories on automobiles is suitable.

Also, in this specification, the relationship of flow-rate vs temperature, and the linearity of the components of the relationship, has been described as linear: this is expressed substantively, not absolutely. For example: a wax-type thermostat has only an approximately linear relationship between temperature change and distance moved. Similarly, in the pump, the relationship of the coolant flow rate to the change in angular orientation of the vanes, is more a raised-power relationship, rather than linear. However, the relationships are described as more or less linear in the context of, for example, a conventional flow-controlling butterfly valve, which is so grossly nonlinear that automatic control of the flow-rate is barely contemplatable.

The temperature-controlled swirl vanes technology, as described above, was aimed at optimising the coolant circulation flowrate to the needs of the engine, while minimising the power needed to drive the coolant circulation pump. Optimising coolant circulation flow-rates is important in keeping particularly the engine oil at optimum temperatures, which is important for vehicle fuel economy.

It will now be described that the temperature-controlled swirl vanes technology may be combined with the requirement an engine has for thermostat control of coolant flow to the radiator. Traditionally, automotive engines have included a (mechanical) thermostat, for managing coolant temperature by controlling flow to the radiator. Basically, the thermostat cuts off or reduces flow to the radiator when the coolant is below a certain temperature, and only allows full flow to the radiator when the coolant has warmed up.

In the automotive embodiments described above, it was arranged that the temperature-controlled swirl vanes were provided as a structurally separate component of the vehicle, from the warm-up thermostat. Alternatively, as will now be described, both the function of modulating the coolant flow rate in accordance with coolant temperature (using thermostatically controlled swirl-vanes), and the function of routing the coolant flow either into or not into the radiator in accordance with coolant temperature (using a thermostat), can be provided in a common structure.

FIGS. 13*a*, 13*b*, 13*c*, 14 show a coolant circulation pump mechanism 230 in which a rotating vanes-ring 232 carries a set of swirl-vanes 234. In this pump, coolant enters the impeller 236 from two sources, being the radiator-port 237 and the heater-port 238. The flow from the ports 237, 238 passes through the swirl-vanes 234, before entering the blades of the impeller 236.

The swirl-vanes 234 are carried on the vanes-ring 232, which may be compared with the ring 45 of FIGS. 2–5. The vanes-ring 232 is rotatable, its orientation being under the control of a thermostat unit 235. (In alternative embodiments, other types of thermally-controlled actuator may be used in place of the thermostat 235.)

A drive-pin 239 connects the stem of the thermostat with the vanes-ring 232. When the stem moves, the drive pin 239 causes the vanes-ring 232 to rotate in a movement that corresponds to, and is in unison with, the movement of the stem. The swirl-vanes 234 are carried in respective pivots mounted in the housing of the pump, whereby the rotation of the vanes-ring 232 causes the angle or orientation of the swirl-vanes to change.

FIG. 14 shows the components of the pump 230 in the COLD position, being the position they adopt while the coolant entering the pump through the heater port 238 is cold (i.e not yet warmed up). In this COLD position, coolant cannot pass from the radiator port 237 into the impeller, becasue the swirl-vanes 234 lie orientated to a CLOSED position.

FIGS. 15*a*, 15*b*, 15*c* show a modified arrangement, having just a single swirl-vane 240. Here, when the coolant is cold, the swirl-vane 240 blocks coolant from the radiator-port from reaching the impeller. When the coolant is warmed up (FIG. 15*b*), coolant can enter the impeller from both ports.

It may be appropriate, in some coolant systems, for the designer to arrange for the input from the engine/heater to be completely blocked, and this can be done if required (FIG. 15*c*). It will be noted that in FIG. 15*a*, when the coolant is cold, the swirl-vane is directing the flow from the engine/heater against the direction of rotation of the impeller, which boosts the flow; whereas the flow from the radiator (FIGS. 15*b*, 15*c*) is directed in the same rotational sense as the impeller, which reduces the flow-boost in that case.

In FIGS. 15*a*, 15*b*, 15*c* the swirl-vane 240 is driven to rotate, not directly by a thermostat element, but by an electric-motor/gearbox arrangement 241. The motor is a stepper-motor, and its rotational position is controlled by signals from a temperature sensor located at a suitable point in the coolant circuit, which may be mechanically separate from the motor/gearbox 241. It should be understood that the motor/gearbox arrangement used in FIGS. 15*a*, 15*b*, 15*c*, with its separate temperature sensor, could be used in place of the mechanical thermostat unit of FIGS. 13*a*, 13*b*, 13*c*, 14, and vice versa. A thermostat (which combines thermal sensor and actuator in one mechanical unit) is not so sophisticated and versatile as to its functionality, but is more economical.

In FIGS. 13*a*, 13*b*, 13*c*, 14 and in FIGS. 15*a*, 15*b*, 15*c* the illustrated structures provide mechanical coordination between the swirl-vanes orientation mechanism, including the vanes-rings 232, and the valve-member orientation mechanism, including the drive-pin 239 or the motor/gearbox 241.

The cooling system of which the pump of FIGS. 13*a*, 13*b*, 13*c*, 14 is a component is of the type in which coolant circulates at all times through the heater (FIG. 16). (In other types of cooling system, flow may be sometimes, in operation, diverted to by-pass the heater.) In FIG. 16, the impeller of the pump P is driven e.g by means of a geared drive, or by means of a belt drive 241, directly from the engine E. In FIG. 16, when the coolant is warmed up, the coolant circulates around the radiator R; when the coolant is cold, coolant cannot circulate around the radiator R, because the swirl-vanes 234 in the pump P lie in their closed position, thus closing off the radiator-port 237. The temperature-sensing bulb in the thermostat 235 is positioned appropriately to measure the temperature of the coolant coming from the engine E (via the heater H) just before the coolant enters the pump P. As shown in FIG. 13*c*, there is a passage 248 between the heater port 238 and the bulb, whereby the bulb is flooded with incoming coolant.

It will be noted, of course, that the separate thermostat valve, which automotive engines usually have, has been eliminated in the circuit of FIG. 16.

There are many different configurations of the components of automotive cooling systems, and the designer will arrange the pump inlets/outlets to suit. That is to say: linking the radiator shut-off thermal control with the swirl-vanes thermal control, as described, might or will require different configurations with different engine systems.

In FIG. 13*a*, the swirl-vanes are in their HOT position—the coolant having warmed up—whereby coolant enters the coolant circulation pump 230 both from the heater-port 238 and from, the radiator port 237. The mouths of the ports 237, 238 are arranged such that water passing into the pump from the heater-port 238 passes straight into the impeller, whereas water from the radiator-port 237 passes through the swirl-vanes 234.

When the coolant passing through the pump 230 is cold, i.e has not yet warmed up, it is desired that the radiator be closed off from the circulating coolant. This is shown in FIG. 14, where flow from the radiator is blocked off, in that the swirl-vanes 234 lie orientated in such position as to block flow from the radiator port 237, i.e to prevent water from the radiator from passing through to the impeller 236. The swirl-vanes have been driven to this position by the thermostat 235 which, in FIG. 14, is in its fully-retracted, COLD, condition. Thus, when the coolant is cold, the coolant passing through the pump, and entering the engine, comprises only coolant that has just come from the engine, via the heater; coolant from the radiator cannot enter the pump, and cannot enter the engine, because the vanes 234 are closed.

As the coolant circulating around the engine warms up, so the thermostat bulb expands, which drives the vanes-ring 232 in an anti-clockwise direction, causing the vanes 234 to open. Now, coolant from the radiator can pass through to the impeller 236.

After that, once the coolant has warmed up, the temperature of the coolant varies in accordance with driving conditions, vehicle loading, ambient temperature, etc; as the coolant becomes hotter, or becomes less hot, the swirl-vanes vary as to their orientation, in accordance with the coolant temperature, in the manner as previously described. Again, the designer should arrange that, once the coolant is up to normal running temperature, the angle the swirl-vanes 234 adopt when the coolant is at its hottest gives the greatest boost to the flowrate, whereas the angle) the vanes adopt when the coolant is at the cooler end of its range of normal-running temperatures gives the greatest reduction (or, it may be termed, gives the smallest boost) to the normal-running flowrate. Typically, the minimum normal-running flowrate may be of the order of half the maximum normal-running flowrate, or less, at a typical pump speed and operating condition. In FIGS. 13*a*, 13*b*, 13*c*, 14, the impeller 136 rotates in an anti-clockwise direction, whereby the above manner of operation obtains.

FIG. 17 is a cross-section of the pump 230 of FIGS. 13*a*, 13*b*, 13*c*, 14. The pump impeller 236 is driven, in this case, by means of a drive belt from the engine, which operates on a drive-pulley 243. Thus, the speed of the pump varies in direct proportion to the speed of the engine. Driving the coolant pump from the engine, although that is a traditional and very common technology, poses the problem that at low engine speeds the pump output (i.e the litres per minute of coolant flow produced by the pump) is not enough to remove all the heat that the engine puts into the coolant; and equally, at high engine speeds, the flowrate is much larger than required, which results in engine power being wasted, and indirectly in that the cooling system has to be engineered to cope with the high flowrates and/or pressures. The designer is thus faced with a compromise, in that the impeller has to produce an adequate flowrate at low pump speeds, and yet must cope with the excessive flowrates and pressures associated with high pump speeds.

One approach to easing this compromise is to provide the impeller with two sets of blades, and to engineer the impeller such that at low speeds (i.e low flowrates) both sets of blades are available to pump the coolant, whereas at high pump speeds (i.e high flowrates) one of the sets of blades is by-passed. The pump impeller 236 has two sets of blades, with the effect as shown in FIGS. 18*a*, 18*b*.

The impeller 236 includes a set of primary blades 244 and a set of secondary blades 245. When the pump drive speed is low, and the flowrate is low, the coolant passes axially through the primary blades 244; the pumped liquid then changes direction, and passes around the promontory 246, and thence passes into the entrances of the secondary blades 245, and then radially through the secondary blades (FIG. 18*a*).

On the other hand, when the impeller speed is high, the flow from the primary blades 244 now has so much axial-velocity momentum that the coolant tends to by-pass the entrances of the secondary blades 245 (FIG. 18*b*). Thus, the secondary blades become starved of liquid.

The secondary blades 245 are radial, whereby the pressure differential between the entrances and the exits of the blades 245 is created by centrifugal force, and can be quite substantial. Thus, provided the liquid near the promontory 246 is moving slowly, the liquid is drawn, quite strongly, into the secondary blades 245. It is recognized that the flow route or pathway around the promontory 246 can be made so tortuous that, as mentioned, only a small proportion of the axial flow emerging from the primary blades 244 reaches the secondary blades 245.

Thus, at low pump-speeds, a high percentage of the flow passes through both the primary blades 244 and the secondary blades 245, whereas, at high pump-speeds, only a much lower percentage of the flow passes through both the primary blades 244 and the secondary blades 245, in that, at high pump speeds, most of the flow passes straight into the outlet scroll chamber 247 without passing through the secondary blades.

The effect is that the amount of coolant pumped per revolution of the blades is boosted at low revolutions because then most of the flow passes through both sets of blades; whereas the amount of coolant pumped per revolution of the blades is reduced (i.e is not boosted so much) at high revolutions because then most of the flow by-passes the secondary blades.

FIG. 19 shows another structure in which a vanes-orientation mechanism is mechanically coordinated with a radiator-port-closing mechanism. FIG. 20 shows the same structure pictorially, partly in cross-section.

In FIG. 19, coolant from the automobile's radiator enters the pump chamber 254 via radiator-port 256. Located in the chamber is a slider 257. When the coolant is hot, the slider 257 lies towards the rightwards extreme, as shown in the lower half of FIG. 19.

The open interior conduit 258 of the slider 257 has a radially-outwards-facing opening 259. This opening 259 connects with the radiator-port 256 when the slider 257 is to the right. Coolant enters the pumping chamber 254 from the radiator, and passes to the pump impeller 260.

Before reaching the blades of the pump impeller 260, the coolant from the radiator-port 256 passes through the swirl-vanes 262. The swirl-vanes 262 impose a bias to the flowing water, giving the coolant a rotary swirl motion. Depending upon the orientation of the swirl-vanes, this swirl motion can be in either the same rotational sense as the rotation of the impeller, or the opposite sense. It will be understood, from a perusal of the flow vectors, that when the swirl-vanes are orientated AGAINST the rotation of the impeller, the volumetric flow-rate through the impeller is boosted, whereas when the swirl-vanes are orientated WITH the rotation of the impeller, the volumetric flow-rate is reduced. The swirl-vanes are orientatable progressively, from a maximum flow-boost orientation through a maximum flow-reduce (or minimum flow-boost) orientation.

The swirl-vanes 262 are mounted in a vane-mounting-structure, comprising a cage, which comprises an inner ring 264 and an outer ring 265. The two rings are fixed together, to form the cage. The two rings define an annular passageway 267. The swirl-vanes straddle the annular passageway 267, radially between the two rings 264, 265.

The rings 264, 265 carry respective pivot bearings 268, 269, in which the swirl-vanes 262 are rotatably mounted. The pivot pin 270 of the swirl-vane 262 has an extension 272, which extends through the bearing 269 in the outer ring 265, and a lever arm 273 is carried on the extension 272. The orientation of the swirl-vane 262 is adjusted by moving the lever arm 273.

The cage 263 is carried in the fixed chamber 254. A peg (not shown) engages a socket in a shoulder 274 of the chamber, to constrain the cage 263 against rotation within the chamber.

A spring (not shown) serves to urge the lever-arms 273 of the swirl-vanes 262 to the left. Noting the direction of rotation of the pump impeller 260, the designer arranges the apparatus so that the more the lever-arms 273 lie to the left (in FIG. 19), the more the swirl-vanes 262 are orientated to the flow-reducing condition. As the lever-arms 273 are moved to the right, the swirl-vanes 262 become more orientated towards the flow-boosting condition. The design of the lever arm and the slider geometry can be designed to suit the particular desired relationship of swirl-bias to slider motion.

Inside the pump chamber 254 is a thermostat unit 275. The unit 275 is conventional, in itself, and includes a bulb which expands as it heats, driving a stem 276 out of the casing 278. The casing 278 is a press fit inside the slider 257. (Again, it will be understood that a thermally-controlled movement-actuator other than a traditional thermostat may be provided, e.g an electrical linear actuator coupled to a thermal sensor, for the purpose of moving the slider.

As the stem 276 moves out of the casing 278, due to a rise in temperature of the coolant flowing over the casing 278, the casing, and the slider 257 to which it is attached, move to the right. The nose 279 of the slider 257 engages the lever-arms 273, whereby thermally-induced movement of the slider in the left-right sense moves the lever-arms 273, giving rise to a change in the orientation of the swirl-vanes.

A lost motion provision may be incorporated into the FIG. 19 design. The designer can provide a gap 281 between the nose 279 and the lever-arms 273. The larger the gap 281, the greater the lost motion, as the water warms, before the lever-arms 273 move. The lost motion provision can be coordinated with the point at which the radiator-port 256 opens.

Designs based on the FIG. 19 illustration can be highly suited to automotive use. The pump unit is structured as a mechanically-compact unit, which can be designed to be attached to the engine-block on a simple bolt-on basis. The unit is self-contained, in that it can be assembled and tested, for most of its functions, while off the engine. In an alternative design, the pump unit is housed within the engine block, rather than in a separate bolt-on housing.

It may especially be noted that the slider 257 and the cage 263 are both accommodated inside the smooth-bored interior of the pump chamber 254. Thus, for servicing, both the slider and the cage can be simply slid out of the chamber, upon removal of the end-cover 277, and this can be done without removing the unit, and without disturbing the hose connections. As mentioned, the cage is pegged against rotation relative to the chamber, and it does not matter if the slider should tend to rotate.

Other arrangements of the components may be engineered: for example, it may be arranged that the cage slides with the slider, whereupon the lever arms may be caused to rotate by contacting the shoulder 274. The thermostat unit may be attached to the end cover, rather than to the slider; however, the designer should prefer an arrangement in which the temperature-sensing portion of the thermostat is actually immersed in the flowing coolant.

Another example of a manner of coordinating coolant flows in the circulation circuit will now be described, referring to FIGS. 21*a*, 21*b*, 21*c*.

When the coolant is cold, in a traditional automotive coolant circulation system, the thermostat has prevented coolant from entering the radiator. When the coolant nears its normal running temperature, the thermostat opens, only then admitting flow to the radiator. However, in traditional automotive systems, the cold coolant, though cut off from the radiator by the closed thermostat, still flows through the heater.

In traditional heater circuits, all or part of the coolant flow that is routed around the engine is also routed around the heater circuit. Some heater circuit include a manually-operated valve, which shuts off flow through the heater, effectively diverting a greater proportion of the coolant flow through the engine by-pass or radiator circuit—i.e not through the heater—thus controlling the heat output of the heater.

Often, when the vehicle is starting from cold, on a cold day, the driver turns the heater control to full heat. If so, a significant portion of the coolant, as it flows around the engine, also flows through the heater, and this can delay warm-up of the coolant in the engine. Delayed warm-up is not preferred, not just for the heater, but especially from the standpoint of engine wear. The time for warm-up can be improved if the heater is kept out of circuit until the coolant is at least partially warmed up. The driver cannot gain any benefit from the heater, anyway, until the coolant has warmed up.

Cutting off flow to the heater when the coolant is very cold, in a traditional system, would seem to require a separate thermostat, because the temperature at which flow should be admitted to the heater is different from the temperature at which flow should be admitted to the radiator.

When the radiator thermostat, i.e the mechanism for opening/closing the radiator port, is mechanically coordinated with the mechanism for changing the orientation of the swirl vanes, as described herein, it is recognized that it is hardly any further complication to arrange for the mechanism also to open/close the heater port, and to do so at the required different temperature.

FIGS. 21*a*, 21*b*, 21*c* show how this may be done. Coolant from the heater enters via heater-port 283, and coolant from the radiator enters via radiator-port 284. The coolant is conveyed along the conduit 285 in the slider 286 to the swirl-vanes, which lie to the right, as in FIG. 19. The slider 286 moves responsively to a temperature-sensitive actuator (not shown).

FIG. 21*a* shows the situation when the coolant is very cold. Here, both the heater-port 283 and the radiator-port 284 are closed, whereby the coolant only circulates around the engine. It will be understood that coolant must still be able to circulate around the engine, even when flow through the heater circuit is closed: therefore, the heater by-pass conduit must have its own entrance port into the pumping chamber, which must be separate from the heater-port 283 since the heater-port 283 may be closed. The by-pass entrance port is not shown in FIGS. 21*a*, 21*b*, 21*c*.

As the coolant starts to warm up, from very cold, the slider 286 moves to the right. Now, although the radiator-port 284 remains closed, the heater-port 283 is open, and the partially warmed-up water can circulate round the heater, subject to the manual heater valves and controls.

Then, as the coolant approaches warmed-up running temperature, the radiator-port 284 also opens. Now, coolant can circulate through the heater (subject to the manual heater valves and controls) and around the radiator.

As shown in FIG. 21*c*, when the coolant is at the limit of maximum hotness, flow through the heater-port 283 is cut off, or is almost cut off.

Whether the heater port remains partly open or is completely closed at very hot temperatures, the point is that the mechanism as described makes it an easy matter for the designer to choose the opening/closing sequences. The exact nature of the overlap or non-overlap of the heater and radiator ports makes little difference to the cost or complexity of the apparatus, giving the designer freedom to arrange overlap as may be desired.

In FIGS. 21*a*, 21*b*, 21*c* the slider 286 also operates the mechanism for orientating the swirl-vanes, and the designer should ensure the correct correspondence and overlap between the closing/opening of the ports and the orientation of the vanes, which will secure good efficiency of the engine under a wide range of operating conditions. But again, the designer is free to choose the exact sequence of closing/opening of the heater and radiator ports, and their interrelationship with the orientation of the swirl-vanes, i.e is free to choose in the sense that, whatever the chosen sequence, it makes little difference to the cost or complexity of the apparatus.

The scope of the invention is defined by the accompanying claims. The manner in which the features recited in the claims interact is shown in FIG. 22.

Some of the following variations in the system are also considered. For example, the coolant pump impeller (rotor) may be centrifugal (radial), or may be a propeller (axial). As another example, the designer might prefer to provide a small supplementary pump for the heater, rather than have the heater flow go through the main pump.

Another variation in the system concerns the orientatable swirl-vanes themselves. The designer must see to it that the swirl-vanes are able to be re-orientated, when that is needed, in a reliable trouble-free manner, over a long service life. However, pivot connections and sliding interfaces can lead to reliability problems. In an alternative structure, the swirl-vanes flex, rather than pivot. That is to say, the vanes are so structured as to bend, rather than pivot, in response to the thermal signal. Although this alternative is more difficult to engineer, the resulting apparatus as a whole may be expected to be more reliable.

The efficiency of the pump is measured as the product of the volumetric flow rate and the pressure of the pumped liquid, per watt of power needed to drive the pump. This efficiency of course is bound to vary, to an extent, with the degree of orientation of the swirl vanes.

It Is recognized, however, that the efficiency of the pump in fact does not go down very much, as the swirl-vanes are re-orientated. It is recognized as a feature of the swirl-vane re-orientation system, as a structure for controlling flow rates through rotary pumps, that the efficiency (i.e the wattage from the motor or driver needed to produce a given pressurised flow-rate) varies relatively little, over a wide range of flow rates, when compared to other flow control structures.

It is also recognized that the flow-rate produced by the pump, as measured in litres per minute, is controllable over a wide range of flow-rates, by controlling the orientation of the swirl-vanes.

Traditional pumps have been subject to large changes in efficiency at the different flowrates. The pump would be designed for good efficiency at a particular operational flow-rate, but the pump would be very inefficient at other flow-rates.

The changes in flow produced by the changes in orientation of the swirl-vanes can be done over a wide range, and without as significant a loss of efficiency over a wide range, as contrasted with other flow-control systems, for example the port-closers, as described.

It is not essential, in the invention, that there be only one thermal sensor. When the thermal sensor takes the form of a mechanical thermostat bulb unit, it can be difficult to coordinate more than one sensor; but when the thermal sensor provides an electronic signal, which is fed onto the engine data bus, there is little difficulty in accommodating and coordinating several sensors, if the designer so wishes. For example, in some installations, the designer may prefer to have temperature sensors e.g in the coolant in the engine, in the radiator, in the heater, in the pump outlet, etc, and (especially) in the engine oil. Then, as engine operating conditions change, the orientations of the swirl-vanes may be coordinated in a more refined and sophisticated manner, aimed at optimising the operating temperature of the engine, and aimed at reducing deviations from the optimum as quickly as possible.

The bus data from the coolant temperature sensors can also be arranged to control the radiator fan. For example, the designer may set the system such that, if there is not much temperature drop through the radiator, the fan may be switched on, or sped up, and coordinated with the orientation of the swirl-vanes.

As mentioned, the temperature sensor(s) may be electronic, and provide simply a voltage, or simply a digital code, as its output. In that case, the output signal may be processed by the vehicle's computer, and the temperature data fed to the vehicle's data bus. The thermal control of the swirl vane orientation apparatus may then include a data-bus reader, and a transducer for converting the temperature data into mechanical movement.

The coolant temperature sensor can be indirect. The sensor might measure engine-oil temperature directly, for example. In fact, measuring the oil temperature can sometimes lead to greater efficiencies; some studies have indicated that controlling the oil temperature can give even greater improvements in efficiency than controlling the coolant temperature—insofar as the two effects can be separated. It should be understood that a sensor that is so placed as to measure directly the engine-oil temperature, is still, for the purposes of the invention, a sensor for measuring the temperature of the engine coolant. Similarly, if the temperature sensor were to be so placed as to measure directly the temperature of the metal of the engine block, that would still, for the purposes of the invention, be a sensor for measuring the temperature of the engine One or the advantageous aspects of the swirl-vane technology is the improved resistance to cavitation in the pump impeller. Cavitation arises when the pressure of the fluid actually in contact with the impeller blades is below the vapour pressure at a given temperature, whereby a cavity of vapour is formed, contiguous to the impeller blades. Cavitation not only spoils the efficiency of the pump, but can lead to vibration, erosion, and other pump problems.

Cavitation in the blades of a pump, if it occurs, can cause a significant drop-off in the volumetric flowrate of the liquid passing through the pump. In an automotive cooling system, pushing back the onset of cavitation can be very important.

It is of course well known that the onset of cavitation can be pushed back if the hydraulic pressure of the liquid is increased. But increasing the pressure carries its own problems. It is recognized that it is not necessarily the hydrostatic pressure in the whole system that determines the onset of cavitation, but rather the hydrodynamic pressure of the liquid as it actually passes through the impeller blades. Hydrodynamic pressure has direction, and it is recognized that the swirl-vanes can be orientated so as to increase or reduce the hydrodynamic pressure of the coolant, just as it passes through the impeller.

Electrically-driven pumps go well with electronic data processing. The combination makes it simple to optimise the output of the pump (for maximum flow-rate, or maximum efficiency, etc, as conditions may require), over the speed range of the engine, and over the temperature and other operating ranges of the engine. As discussed, although it is easy to control the speed of an electric motor, and thus it is easy to tailor the pump output to system requirements, still, controlling pump output by controlling the orientation of the swirl-vanes in accordance with temperature gives better results. By being able to tailor both the swirl-vanes orientation, and the pump speed, in accordance with temperature (and other parameters), engine coolant temperatures can be kept very close to optimum under almost all conditions.

But even when the coolant pump is mechanically driven, from the engine, deriving temperature sensor data electronically, from the data bus, can give better results than using a mechanical thermostat unit.

When the temperature sensor data is in the form of an electronic signal on the data bus, the designer may arrange for the swirl-vanes to be orientated by means of a computer-controlled stepper-motor, or servo, which again is in keeping with the trend towards greater electronic control.

When the temperature information is in the form of an electronic signal on the data bus, the designer is able to also arrange to coordinate the radiator cooling fan motor with the pump speed, in order to realise better overall efficiencies in the coolant system. The designer's overall aim (usually) is to maintain optimal engine temperature, while expending a minimum amount of energy to run the coolant system.

Thus, when the degree of swirl-vane biassing is controlled by the temperature of the coolant, as engine-monitoring becomes more sophisticated, so it becomes more possible for the volumetric flowrate produced by the coolant pump to be truly optimised to the thermal conditions.

When the temperature sensor signals are electronic, generally there is no mechanical connection between the structure of the temperature sensor and the structure that moves the vanes. Rather, the signal controls a servo, and it is the servo that provides the mechanical drive to re-orientate the swirl-vanes.

When the coolant pump is driven by an electric motor, it can be beneficial for the designer, to specify that the motor run at constant speed. However, constant speed is not essential. There is a trend, in electric motors, to commutate electric motors electronically, not mechanically. The motor speed will be on the data bus, whereby it becomes a relatively simply matter to relate motor speed to coolant temperature, as well as to relate swirl-vane orientation to coolant temperature.

In the traditional simple type of automotive thermostat, a desideratum has been that the thermostat should remain closed up to a temperature close to 195 deg-F., but beyond that the thermostat should suddenly go fully open. In practice, opening does not take place suddenly, once the set temperature is reached; rather, a conventional simple thermostat might be set to start to open at a temperature of e.g 180 deg-F., and opening is not complete until about 200 deg-F.

FIG. 23 is a graph showing the characteristic of the thermostat 235, which is of the type known as a double-break thermostat. Here, the y-axis represents the extension of the stem of the thermostat bulb unit, for the different temperatures as plotted on the x-axis. The stem starts to move at about 200 deg-F., and moves then at quite a high rate, whereby the stem has extended 0.14 inches at 209 deg-F. After that, the stem moves at the very slow rate of about 0.01 inches per ten degrees rise, whereby for the next 26 degrees, i.e up to 235 deg-F., the stem moves only a further 0.04 inches. Beyond 235 deg-F., the stem moves at the rather greater rate of 0.05 inches per ten degrees rise.

It is recognized that the double-break thermostat bulb unit is very well suited to the system as described herein in relation to FIG. 13 et seq, where the function conventionally performed by the engine radiator thermostat valve is performed by the swirl-vanes. The initial movement of the stem takes place relatively suddenly, and the movement of the stem is of sufficient magnitude as can easily be harnessed to move the swirl-vanes from the closed position to the position of minimum flow-boost. After that, the change in the orientation of the swirl-vanes per degree of coolant temperature is very small, whereby the swirl-vanes remain more or less stationary in the minimum flow-boost orientation until the temperature reaches about 235 deg-F. Beyond that, the swirl-vanes start to change orientation at a more rapid rate, up to the maximum flow-boost position, which occurs at about 260 deg-F.

With a double-break thermostat, of course the designer can specify the change points to be at particular temperatures, as required, to suit the characteristics of particular engines. The benefit of the double-break thermostat is that it provides different rates of movement of the stem (i.e rate, as measured in inches-per-degree) over different temperature ranges. Initially, the swirl-vanes move from closed to partway open very rapidly, just as the coolant reaches warmed-up temperature. If that initially-rapid rate of movement were to be repeated throughout the full temperature range of the thermostat, it would be hard to harness the movement for the purposes of controlling the orientation of the swirl-vanes. It is a simple matter to tailor the stem movement per degree, to be more or less exactly what is required, i.e; rapid rate at first (to open the radiator port just as the coolant goes from cold to warmed-up); then slow rate (to leave the swirl-vanes more or less unchanged as the coolant goes from just-warmed-up to hot); then rapid again, though not so rapid as initially (to effect movement of the swirl-vanes, to give a large flow boost, as the coolant goes from hot to very hot).

Thus, the double-break mechanical thermostat (known per se) is of considerable benefit when used in the kind of coolant pump as described, where the stem movement of just one thermostat is used both to effect the close/open movement of the radiator-port-closer, and to effect the progressive flow-control and flow-boost movement of the variable swirl-vanes.

Similarly, in installations where the temperature sensing is done with electronic sensors, and the movement of the radiator-port-closer and of the swirl-vanes is done by e.g computer-controlled stepper motors, it is a simple matter in that case, too, for the designer to ensure that the movements of the components are co-ordinated in the most efficacious manner.

FIG. 24 is a Table showing different modes of operation of the coolant circulation system, of a particular vehicle. In this vehicle, the coolant pump is powered by a gear drive from the engine, and in which the same thermal actuator is used to actuate both the radiator port closer and the swirl vanes.

In the case of a particular vehicle, fully loaded, travelling uphill, on a hot day, the coolant flowrate might need to be, for example, 100 litres per minute. On the other hand, the same vehicle, cold day, downhill at the same speed, might need less than a tenth of that flowrate. It may be expected that the thermally-actuated swirl-vanes, as described herein, when properly designed, can enable at least most of that difference to be achieved, However, when the swirl-vanes are compromised by combining the function also of opening/closing the radiator port, it may be expected that, while such very large differences in flowrate cannot be achieved, still the cost savings arising from the fewer components make the combined-action swirl-vanes worthwhile.

Ideally, the thermal-actuation of the swirl-vanes, as described herein can, at least notionally, provide a coolant flowrate that, under all operating conditions, is effective to keep engine temperature optimum, and to be so by providing just the flowrate required, without wasting excessive flowrates and pressures under some conditions. Combining the thermally-actuated radiator-port-closer with the thermally-actuated swirl-vanes is a compromise, which makes the above ideal rather less obtainable, than when the two thermal actuators are separate and independent; but on the other hand, using the same thermal actuator for both tasks gives a considerable cost saving, compared with using independent thermal actuators.

In other words, providing thermally-actuated swirl-vanes to adjust coolant flow enables large economies to be made overall to a vehicle's cooling system. This is true, especially, when the radiator port is opened/closed by means of its own independent thermostat. But combining the thermal-actuators is a direct cost saving, which at the same time enables at least a portion of those overall economies to be made.

FIGS 25*a*, 25*b*, 25*c*, 25*d*, 25*e* represent the changing positions of the thermal-driver 320 of a coolant pump as the coolant goes from cold to cool to warm to hot to very hot, respectively. As the coolant goes from cold to warm (FIGS. 25*a*–25*c*) the rad-port-closer 322 moves with the thermal-driver 320. whereby the radiator port is changed from closed to open. During the movements of FIGS. 25*a*–25*c*, the swirl-vane 324 of the pump remains stationary. (The intermediate conditions, FIGS. 25*b*, 25*d*, are placed on a separate sheet.)

Further movement of the thermal-driver 320, due to a further rise in coolant temperature, beyond the FIG. 25*c* position, now picks up the swirl-vane 324 and moves it from a flow-reducing orientation to a flow-boosting orientation. During the movements of FIGS. 25*c*–25*e*, the rad-port-closer 322 remains stationary.

As Shown in FIG. 25*e*, the overall range of movement of the thermal-driver is made up of two portions, a rad-port-closure-portion, which corresponds to the range of movement of the rad-port-closer 322, and a vane-orientation-portion, which corresponds to the range of movement of the swirl-vane 324.

The vane-orientation-portion of the overall range of movement of the thermal-driver 320 can be arranged to overlap the rad-port-closure-portion of the overall range of movement of the thermal-driver. This condition is shown in FIGS. 26*a*, 26*b*. Here, the designer has arranged that the rad-port-closer 322 and the swirl-vane 324 are both moved, in unison, by the thermal-driver, over a unison-portion of the overall range of movement of the thermal-driver. Thus, the overall range of movement of the thermal-driver is now smaller than the sum of the rad-port-closure-portion and the vane-orientation-portion, by the unison-portion, as is shown in FIG. 26*b*. To permit the unison-portion to be illustrated, FIG. 26*a* shows two conditions, the upper condition where the thermal-driver, in moving to the right as the coolant temperature rises, is just starting to pick up the swirl-vane 324, but the red-port-closer still has not reached the rightward extreme of its movement. The lower condition occurs when the coolant is a little warmer, and now the rad-port-closer cannot move any further rightwards.

Similarly, the designer may arrange a gap between the movement of the rad-part-closer and the movement of the swirl-vane, FIGS. 27*a*–27*c*. In FIG. 27*a*, the rad-port-closer 322 has reached the rightwards extreme of its travel, but the thermal-driver 320 still has some way to go before it picks up the swirl-vane 324. Thus, as the thermal-driver moves from the FIG. 27*a* condition to the FIG. 27*b* condition, neither the rad-port-closer 322 nor the swirl-vane 324 moves. Thus, the overall range of movement of the thermal-driver is now larger than the sum of the rad-port-closure-portion and the vane-orientation-portion, by the lost-motion-portion, as is shown in FIG. 27*c*.

What is claimed is:

1. A coolant pumping apparatus, wherein:

the apparatus is structured for pumping liquid coolant around the coolant circulation circuit of an engine and associated radiator;

the apparatus includes a fixed housing, having walls which define a pumping chamber;

the apparatus includes a pump impeller, having blades, and includes a rotary-driver for rotating the impeller;

the pump impeller lies inside the pumping chamber, and is effective to pump coolant through the chamber;

the walls of the pumping chamber include a radiator-port, for making coolant-conducting communication between the pumping-chamber and the radiator;

the apparatus includes a radiator-port-closer;

the radiator-port-closer is mechanically movable in a port-closure mode of movement, being movement between a port-open position with respect to the said radiator-port, and a port-closed position;

the apparatus includes a swirl-vane;

the swirl-vane is so arranged in relation to the impeller as to impart a rotary swirl motion to the flow of coolant passing through the impeller;

the apparatus includes a vane-mounting-structure, having a vane-orientation-guide;

the swirl-vane is mechanically movable in a vane-orientation mode of movement, its movement constrained by the vane-orientation-guide, being movement between a flow-reducing orientation of the swirl-vane relative to the blades of the rotary impeller, and a flow-boosting orientation;

the apparatus includes a thermal-unit, having a coolant-temperature sensor;

the thermal-unit includes a fixed-element and a movable-element;

the movable-element is movable relative to the fixed-element, in response to changes in the coolant-temperature sensed by the sensor;

the apparatus includes a thermal-driver;

the thermal-driver is a mechanically-unitary structure, which is so structured as to convert movement of the movable-element of the thermal-unit into both movement of the radiator-port-closer in the port-closure mode, and movement of the swirl-vane in the vane-orientation mode.

2. Apparatus of claim 1, wherein the thermal-driver is so structured that:

the radiator-port-closer substantially cannot move, in the port-closure mode, other than in correspondence with movement of the thermal-driver; and the swirl-vanes substantially cannot move, in the vane-orientation mode, other than in correspondence with movement of the thermal-driver.

3. Apparatus of claim 1, wherein:

the thermal-driver is so structured that movement of the thermal-driver, responsive to an increase in the coolant-temperature from cold to hot, is effective:

to move the radiator-port-closer, in the said port-closure mode, away from the radiator-port-closed position towards the radiator-port-open position; and also to move the swirl-vane, in the said vane-orientation mode, away from the flow-reducing orientation towards the flow-boosting orientation.

4. Apparatus of claim 1, wherein:

the thermal-driver has an overall range of movement, from cold to hot;

the thermal-driver is so structured that the movement of the radiator-port-closer, in the port-closure mode, towards the radiator-port-open position, occurs as a radiator-port-closer portion of the overall range of movement of the thermal-driver;

and the movement of the swirl-vane, in the vane-orientation mode, towards the flow-boosting orientation, occurs as a vane-orientation portion of the overall range of movement of the thermal-driver.

5. Apparatus of claim 1, wherein the thermal-driver is so structured that:

the radiator-port-closer portion of the overall range of movement of the thermal-driver occurs when the temperature of the coolant is towards the cold end of the range;

the vane-orientation portion of the overall range of movement of the thermal-driver occurs when the temperature of the coolant is towards the hot end of the range.

6. Apparatus of claim 1, wherein the thermal-driver is so structured that:

there is no overlap between the radiator-port-closer portion of the overall range of movement of the thermal-driver and the vane-orientation portion;

in that the radiator-port-closer portion is finished, the radiator-port being then open to full flow of coolant therethrough, substantially before the vane-orientation portion commences.

7. Apparatus of claim 1, wherein the thermal-driver is so structured that:

over a unison-portion of the overall range of movement of the thermal-driver, there is overlap between the radiator-port-closer portion of the overall range of movement of the thermal-driver, and the vane-orientation portion;

in that, over the unison-portion, the thermal-driver constrains the swirl-vane and the radiator-port-closer to move together, in unison.

8. Apparatus of claim 1, wherein the thermal-driver is so structured that, over a lost-motion portion of the overall range of movement of the thermal-driver, movement of the thermal-driver produces corresponding movement of one of either the radiator-port-closer or the swirl-vane, while the other does not undergo corresponding movement.

9. Apparatus of claim 1, wherein the coolant-temperature-sensor of the thermal-unit includes two sensors, being a radiator-port-temperature-sensor and a swirl-vane-temperature-sensor, which are physically separate, and are so located as to measure coolant temperatures at different locations of the coolant circulation circuit.

10. Apparatus of claim 1, wherein the coolant-temperature-sensor of the thermal-unit measures temperatures at one location of the coolant circulation circuit.

11. Apparatus of claim 1, wherein:

the apparatus is structured to be suitable for pumping liquid coolant around a coolant circulation circuit that also includes an associated heater;

the walls of the pumping chamber include a heater-port, for making coolant-conducting communication between the pumping-chamber and the heater;

the apparatus includes a heater-port-closer;

the heater-port-closer is mechanically movable in a port-closure mode of movement, being movement between a port-open position with respect to the said heater-port, and a port-closed position;

the apparatus includes a heater-port-closer-linkage, which converts movement of the movable thermal-driver into corresponding movement, in the port-closure mode, of the heater-port-closer.

12. Apparatus of claim 11, wherein:

the heater-port-closer substantially cannot move, in the port-closure mode, other than in correspondence with movement of the thermal-driver;

movement of the thermal-driver, responsive to changes in the coolant-temperature from cold to hot, is effective also to move the heater-port-closer, in the said port-closure mode, from the port-open position to the port-closed position.

13. Apparatus of claim 1, wherein the thermal-driver comprises a mechanical thermostat, having a temperature-sensitive bulb which expands and contracts in accordance with the temperature of the coolant, and the movable-element comprises a movable stem of the thermostat.

14. Apparatus of claim 1, wherein:

a rate of the thermostat is the movement of the stem, in length units, per degree change in temperature of coolant, and:

the thermostat has two different rates, being an initial-opening rate, and a warmed-up rate;

the initial-opening rate is the rate of movement of the stem that obtains upon the coolant reaching a warmed-up temperature, to move the radiator-port closer from the closed to the open position;

the thermal-driver is a mechanically-unitary structure, which is so structured as to convert movement of the movable-element of the thermal-unit into both movement of the radiator-port-closer in the port-closure mode, and movement of the swirl-vane in the vane-orientation mode.

15. Apparatus of claim 14, wherein the warmed-up rate is in two parts, being a cooler part and a hotter part of the warmed-up temperature range, and the rate in the hotter part is greater than the rate in the cooler part.

16. Apparatus of claim 1, wherein:

the swirl-vanes are situated close to the impeller, and upstream of the impeller;

the radiator port in the pump housing is situated upstream of the swirl-vanes;

coolant to be pumped is fed into the pump via an engine/heater port, which is situated upstream of the swirl-vanes;

pumped coolant emerges from the pump via an engine-return port, which is situated downstream of the impeller.

17. Apparatus of claim 1, wherein:

the impeller has a set of primary blades and a set of secondary blades;

the impeller is so shaped and configured that coolant emerging from the primary blades has such direction and velocity as to be partially deflected away from the entrances of the secondary blades;

whereby, when the impeller is rotating at slow rotational speeds, a relatively large proportion of the flow emerging from the primary blades enters the secondary blades, but, when the impeller is rotating at high speeds, only a relatively small proportion of the flow emerging from the primary blades enters the secondary blades.

18. Apparatus of claim 1, wherein the primary blades are predominantly axial and the secondary blades are predominantly radial.

19. Apparatus of claim 1, wherein:

the walls of the pumping chamber include a heater-port, through which coolant from the engine, being coolant that has by-passed the radiator, can enter the pumping chamber;

the apparatus includes a heater-port-closer, which is effective to close the heater-port in accordance responsively to the temperature of the coolant.

* * * * *